US010286450B2

(12) United States Patent
Tallman et al.

(10) Patent No.: US 10,286,450 B2
(45) Date of Patent: May 14, 2019

(54) METHOD AND ASSEMBLY FOR FORMING COMPONENTS USING A JACKETED CORE

(71) Applicant: General Electric Company, Schenectady, NY (US)

(72) Inventors: James Albert Tallman, Glenville, NY (US); Stephen Francis Rutkowski, Duanesburg, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 88 days.

(21) Appl. No.: 15/140,050

(22) Filed: Apr. 27, 2016

(65) Prior Publication Data

US 2017/0312815 A1 Nov. 2, 2017

(51) Int. Cl.
*B22D 19/00* (2006.01)
*B22C 9/10* (2006.01)
(Continued)

(52) U.S. Cl.
CPC ..... *B22D 19/0054* (2013.01); *B22C 7/005* (2013.01); *B22C 7/023* (2013.01);
(Continued)

(58) Field of Classification Search
CPC ..... B22C 7/00; B22C 7/005; B22C 7/023; B22C 9/04; B22C 9/046; B22C 9/06;
(Continued)

(56) References Cited

U.S. PATENT DOCUMENTS 2,687,278 A 8/1954 Smith et al.
2,756,475 A 7/1956 Hanink et al.
(Continued)

FOREIGN PATENT DOCUMENTS

CH 640440 A5 1/1984
EP 0025481 A1 3/1981
(Continued)

OTHER PUBLICATIONS

Ziegelheim, J. et al., "Diffusion bondability of similar/dissimilar light metal sheets," Journal of Materials Processing Technology 186.1 (May 2007): 87-93.
(Continued)

*Primary Examiner* — Kevin P Kerns
(74) *Attorney, Agent, or Firm* — GE Global Patent Operation; John Darling

(57) ABSTRACT

A mold assembly for use in forming a component having an outer wall of a predetermined thickness includes a mold and a jacketed core. The jacketed core includes a jacket that includes a first jacket outer wall coupled against an interior wall of the mold, a second jacket outer wall positioned interiorly from the first jacket outer wall, and at least one jacketed cavity defined therebetween. The at least one jacketed cavity is configured to receive a molten component material therein. The jacketed core also includes a core positioned interiorly from the second jacket outer wall. The core includes a perimeter coupled against the second jacket outer wall. The jacket separates the perimeter from the interior wall by the predetermined thickness, such that the outer wall is formable between the perimeter and the interior wall.

16 Claims, 11 Drawing Sheets

(51) Int. Cl.

| | |
|---|---|
| ***B22C 9/24*** | (2006.01) |
| ***B22C 7/00*** | (2006.01) |
| ***B22C 9/06*** | (2006.01) |
| ***F01D 5/18*** | (2006.01) |
| ***F01D 9/04*** | (2006.01) |
| ***F01D 25/12*** | (2006.01) |
| ***B22C 7/02*** | (2006.01) |
| ***B22C 9/04*** | (2006.01) |

(52) U.S. Cl.

CPC ..... *B22C 9/04* (2013.01); *B22C 9/046* (2013.01); *B22C 9/06* (2013.01); *B22C 9/10* (2013.01); *B22C 9/101* (2013.01); *B22C 9/103* (2013.01); *B22C 9/106* (2013.01); *B22C 9/108* (2013.01); *B22C 9/24* (2013.01); *B22D 19/0072* (2013.01); *B22D 19/0081* (2013.01); *F01D 5/186* (2013.01); *F01D 9/041* (2013.01); *F01D 25/12* (2013.01); *F05D 2220/32* (2013.01); *F05D 2230/211* (2013.01); *F05D 2260/201* (2013.01)

(58) Field of Classification Search

CPC .. B22C 9/24; B22C 9/10; B22C 9/101; B22C 9/103; B22C 9/106; B22C 9/108; B22D 19/00; B22D 19/0072; B22D 19/0081

USPC ..... 164/19, 24, 75, 91, 132, 365, 366, 367, 164/369

See application file for complete search history.

(56) References Cited

U.S. PATENT DOCUMENTS

| | | | |
|---|---|---|---|
| 2,991,520 | A | 7/1961 | Dalton |
| 3,222,435 | A | 12/1965 | Mellen, Jr. et al. |
| 3,222,737 | A | 12/1965 | Reuter |
| 3,475,375 | A | 10/1969 | Yates |
| 3,563,711 | A | 2/1971 | Hammond et al. |
| 3,596,703 | A | 8/1971 | Bishop et al. |
| 3,597,248 | A | 8/1971 | Yates |
| 3,662,816 | A | 5/1972 | Bishop et al. |
| 3,678,987 | A | 7/1972 | Kydd |
| 3,689,986 | A | 9/1972 | Kentaro et al. |
| 3,694,264 | A | 9/1972 | Weinland et al. |
| 3,773,506 | A | 11/1973 | Larker et al. |
| 3,824,113 | A | 7/1974 | Loxley et al. |
| 3,844,727 | A | 10/1974 | Copley et al. |
| 3,863,701 | A | 2/1975 | Niimi et al. |
| 3,866,448 | A | 2/1975 | Dennis et al. |
| 3,921,271 | A | 11/1975 | Dennis et al. |
| 3,996,048 | A | 12/1976 | Fiedler |
| 4,096,296 | A | 6/1978 | Galmiche et al. |
| 4,130,157 | A | 12/1978 | Miller et al. |
| 4,148,352 | A | 4/1979 | Sensui et al. |
| 4,236,568 | A | 12/1980 | Larson |
| 4,285,634 | A | 8/1981 | Rossman et al. |
| 4,352,390 | A | 10/1982 | Larson |
| 4,372,404 | A | 2/1983 | Drake |
| 4,375,233 | A | 3/1983 | Rossmann et al. |
| 4,417,381 | A | 11/1983 | Higginbotham |
| 4,432,798 | A | 2/1984 | Helferich et al. |
| 4,557,691 | A | 12/1985 | Martin et al. |
| 4,576,219 | A | 3/1986 | Uram |
| 4,583,581 | A | 4/1986 | Ferguson et al. |
| 4,604,780 | A | 8/1986 | Metcalfe |
| 4,637,449 | A | 1/1987 | Mills et al. |
| 4,738,587 | A | 4/1988 | Kildea |
| 4,859,141 | A | 8/1989 | Maisch et al. |
| 4,905,750 | A | 3/1990 | Wolf |
| 4,911,990 | A | 3/1990 | Prewo et al. |
| 4,964,148 | A | 10/1990 | Klostermann et al. |
| 4,986,333 | A | 1/1991 | Gartland |
| 5,052,463 | A | 10/1991 | Lechner et al. |
| 5,083,371 | A | 1/1992 | Leibfried et al. |
| 5,243,759 | A | 9/1993 | Brown et al. |
| 5,248,869 | A | 9/1993 | Debell et al. |
| 5,273,104 | A | 12/1993 | Renaud et al. |
| 5,291,654 | A | 3/1994 | Judd et al. |
| 5,295,530 | A | 3/1994 | O'Connor et al. |
| 5,332,023 | A | 7/1994 | Mills |
| 5,350,002 | A | 9/1994 | Orton |
| 5,355,668 | A | 10/1994 | Weil et al. |
| 5,371,945 | A | 12/1994 | Schnoor |
| 5,387,280 | A | 2/1995 | Kennerknecht |
| 5,394,932 | A | 3/1995 | Carozza et al. |
| 5,398,746 | A | 3/1995 | Igarashi |
| 5,413,463 | A | 5/1995 | Chin et al. |
| 5,465,780 | A | 11/1995 | Muntner et al. |
| 5,467,528 | A | 11/1995 | Bales et al. |
| 5,468,285 | A | 11/1995 | Kennerknecht |
| 5,482,054 | A | 1/1996 | Slater et al. |
| 5,498,132 | A | 3/1996 | Carozza et al. |
| 5,505,250 | A | 4/1996 | Jago |
| 5,507,336 | A | 4/1996 | Tobin |
| 5,509,659 | A | 4/1996 | Igarashi |
| 5,524,695 | A | 6/1996 | Schwartz |
| 5,569,320 | A | 10/1996 | Sasaki et al. |
| 5,611,848 | A | 3/1997 | Sasaki et al. |
| 5,664,628 | A | 9/1997 | Koehler et al. |
| 5,679,270 | A | 10/1997 | Thornton et al. |
| 5,738,493 | A | 4/1998 | Lee et al. |
| 5,778,963 | A | 7/1998 | Parille et al. |
| 5,810,552 | A | 9/1998 | Frasier |
| 5,820,774 | A | 10/1998 | Dietrich |
| 5,909,773 | A | 6/1999 | Koehler et al. |
| 5,924,483 | A | 7/1999 | Frasier |
| 5,927,373 | A | 7/1999 | Tobin |
| 5,947,181 | A | 9/1999 | Davis |
| 5,951,256 | A | 9/1999 | Dietrich |
| 5,976,457 | A | 11/1999 | Amaya et al. |
| 6,029,736 | A | 2/2000 | Naik et al. |
| 6,039,763 | A | 3/2000 | Shelokov |
| 6,041,679 | A | 3/2000 | Slater et al. |
| 6,068,806 | A | 5/2000 | Dietrich |
| 6,186,741 | B1 | 2/2001 | Webb et al. |
| 6,221,289 | B1 | 4/2001 | Corbett et al. |
| 6,234,753 | B1 | 5/2001 | Lee |
| 6,244,327 | B1 | 6/2001 | Frasier |
| 6,251,526 | B1 | 6/2001 | Staub |
| 6,327,943 | B1 | 12/2001 | Wrigley et al. |
| 6,359,254 | B1 | 3/2002 | Brown |
| 6,441,341 | B1 | 8/2002 | Steibel et al. |
| 6,467,534 | B1 | 10/2002 | Klug et al. |
| 6,474,348 | B1 | 11/2002 | Beggs et al. |
| 6,505,678 | B2 | 1/2003 | Mertins |
| 6,557,621 | B1 | 5/2003 | Dierksmeier et al. |
| 6,578,623 | B2 | 6/2003 | Keller et al. |
| 6,605,293 | B1 | 8/2003 | Giordano et al. |
| 6,615,470 | B2 | 9/2003 | Corderman et al. |
| 6,623,521 | B2 | 9/2003 | Steinke et al. |
| 6,626,230 | B1 | 9/2003 | Woodrum et al. |
| 6,634,858 | B2 | 10/2003 | Roeloffs et al. |
| 6,637,500 | B2 | 10/2003 | Shah et al. |
| 6,644,921 | B2 | 11/2003 | Bunker et al. |
| 6,670,026 | B2 | 12/2003 | Steibel et al. |
| 6,694,731 | B2 | 2/2004 | Kamen et al. |
| 6,773,231 | B2 | 8/2004 | Bunker et al. |
| 6,799,627 | B2 | 10/2004 | Ray et al. |
| 6,800,234 | B2 | 10/2004 | Ferguson et al. |
| 6,817,379 | B2 | 11/2004 | Perla |
| 6,837,417 | B2 | 1/2005 | Srinivasan |
| 6,896,036 | B2 | 5/2005 | Schneiders et al. |
| 6,913,064 | B2 | 7/2005 | Beals et al. |
| 6,929,054 | B2 | 8/2005 | Beals et al. |
| 6,955,522 | B2 | 10/2005 | Cunha et al. |
| 6,986,381 | B2 | 1/2006 | Ray et al. |
| 7,028,747 | B2 | 4/2006 | Widrig et al. |
| 7,036,556 | B2 | 5/2006 | Caputo et al. |
| 7,052,710 | B2 | 5/2006 | Giordano et al. |
| 7,073,561 | B1 | 7/2006 | Henn |
| 7,093,645 | B2 | 8/2006 | Grunstra et al. |
| 7,108,045 | B2 | 9/2006 | Wiedemer et al. |
| 7,109,822 | B2 | 9/2006 | Perkins et al. |

(56) References Cited

U.S. PATENT DOCUMENTS 7,174,945 B2 2/2007 Beals et al.
7,185,695 B1 3/2007 Santeler
7,207,375 B2 4/2007 Turkington et al.
7,234,506 B2 6/2007 Grunstra et al.
7,237,375 B2 7/2007 Humcke et al.
7,237,595 B2 7/2007 Beck et al.
7,240,718 B2 7/2007 Schmidt et al.
7,243,700 B2 7/2007 Beals et al.
7,246,652 B2 7/2007 Fowler
7,270,170 B2 9/2007 Beals et al.
7,270,173 B2 9/2007 Wiedemer et al.
7,278,460 B2 10/2007 Grunstra et al.
7,278,463 B2 10/2007 Snyder et al.
7,306,026 B2 12/2007 Memmen
7,322,795 B2 1/2008 Luczak et al.
7,325,587 B2 2/2008 Memmen
7,334,625 B2 2/2008 Judge et al.
7,343,730 B2 3/2008 Humcke et al.
7,371,043 B2 5/2008 Keller
7,371,049 B2 5/2008 Cunha et al.
7,377,746 B2 5/2008 Brassfield et al.
7,410,342 B2 8/2008 Matheny
7,438,118 B2 10/2008 Santeler
7,448,433 B2 11/2008 Ortiz et al.
7,448,434 B2 11/2008 Turkington et al.
7,461,684 B2 12/2008 Liu et al.
7,478,994 B2 1/2009 Cunha et al.
7,517,225 B2 4/2009 Cherian
7,575,039 B2 8/2009 Beals et al.
7,588,069 B2 9/2009 Munz et al.
7,624,787 B2 12/2009 Lee et al.
7,625,172 B2 12/2009 Walz et al.
7,673,669 B2 3/2010 Snyder et al.
7,686,065 B2 3/2010 Luczak
7,713,029 B1 5/2010 Davies
7,717,676 B2 5/2010 Cunha et al.
7,722,327 B1 5/2010 Liang
7,802,613 B2 5/2010 Bullied et al.
7,727,495 B2 6/2010 Burd et al.
7,731,481 B2 6/2010 Cunha et al.
7,753,104 B2 7/2010 Luczak et al.
7,757,745 B2 7/2010 Luczak
7,771,210 B2 8/2010 Cherian
7,779,892 B2 8/2010 Luczak et al.
7,789,626 B1 9/2010 Liang
7,798,201 B2 9/2010 Bewlay et al.
7,806,681 B2 10/2010 Fieck et al.
7,861,766 B2 1/2011 Bochiechio et al.
7,882,884 B2 2/2011 Beals et al.
7,938,168 B2 5/2011 Lee et al.
7,947,233 B2 5/2011 Burd et al.
7,963,085 B2 6/2011 Sypeck et al.
7,993,106 B2 8/2011 Walters
8,057,183 B1 11/2011 Liang
8,066,483 B1 11/2011 Liang
8,100,165 B2 1/2012 Piggush et al.
8,113,780 B2 2/2012 Cherolis et al.
8,122,583 B2 2/2012 Luczak et al.
8,137,068 B2 3/2012 Surace et al.
8,162,609 B1 4/2012 Liang
8,167,537 B1 5/2012 Plank et al.
8,171,978 B2 5/2012 Propheter-Hinckley et al.
8,181,692 B2 5/2012 Frasier et al.
8,196,640 B1 6/2012 Paulus et al.
8,251,123 B2 8/2012 Farris et al.
8,251,660 B1 8/2012 Liang
8,261,810 B1 9/2012 Liang
8,291,963 B1 10/2012 Trinks et al.
8,297,455 B2 10/2012 Smyth
8,302,668 B1 11/2012 Bullied et al.
8,303,253 B1 11/2012 Liang
8,307,654 B1 11/2012 Liang
8,317,475 B1 11/2012 Downs
8,322,988 B1 12/2012 Downs et al.
8,336,606 B2 12/2012 Piggush
8,342,802 B1 1/2013 Liang
8,366,394 B1 2/2013 Liang
8,381,923 B2 2/2013 Smyth
8,414,263 B1 4/2013 Liang
8,500,401 B1 8/2013 Liang
8,506,256 B1 8/2013 Brostmeyer et al.
8,535,004 B2 9/2013 Campbell
8,622,113 B1 1/2014 Rau, III
8,678,766 B1 3/2014 Liang
8,734,108 B1 5/2014 Liang
8,753,083 B2 6/2014 Lacy et al.
8,770,931 B2 7/2014 Alvanos et al.
8,777,571 B1 7/2014 Liang
8,793,871 B2 8/2014 Morrison et al.
8,794,298 B2 8/2014 Schlienger et al.
8,807,943 B1 8/2014 Liang
8,813,812 B2 8/2014 Ellgass et al.
8,813,824 B2 8/2014 Appleby et al.
8,858,176 B1 10/2014 Liang
8,864,469 B1 10/2014 Liang
8,870,524 B1 10/2014 Liang
8,876,475 B1 11/2014 Liang
8,893,767 B2 11/2014 Mueller et al.
8,899,303 B2 12/2014 Mueller et al.
8,906,170 B2 12/2014 Gigliotti, Jr. et al.
8,911,208 B2 12/2014 Propheter-Hinckley et al.
8,915,289 B2 12/2014 Mueller et al.
8,936,068 B2 1/2015 Lee et al.
8,940,114 B2 1/2015 James et al.
8,969,760 B2 3/2015 Hu et al.
8,978,385 B2 3/2015 Cunha
8,993,923 B2 3/2015 Hu et al.
8,997,836 B2 4/2015 Mueller et al.
9,038,706 B2 5/2015 Hillier
9,051,838 B2 6/2015 Wardle et al.
9,057,277 B2 6/2015 Appleby et al.
9,057,523 B2 6/2015 Cunha et al.
9,061,350 B2 6/2015 Bewlay et al.
9,079,241 B2 7/2015 Barber et al.
9,079,803 B2 7/2015 Xu
9,174,271 B2 11/2015 Newton et al.
2001/0044651 A1 11/2001 Steinke et al.
2002/0029567 A1 3/2002 Kamen et al.
2002/0182056 A1 12/2002 Widrig et al.
2002/0187065 A1 12/2002 Amaya et al.
2002/0190039 A1 12/2002 Steibel et al.
2002/0197161 A1 12/2002 Roeloffs et al.
2003/0047197 A1 3/2003 Beggs et al.
2003/0062088 A1 4/2003 Perla
2003/0133799 A1 7/2003 Widrig et al.
2003/0150092 A1 8/2003 Corderman et al.
2003/0199969 A1 10/2003 Steinke et al.
2003/0201087 A1 10/2003 Devine et al.
2004/0024470 A1 2/2004 Giordano et al.
2004/0055725 A1 3/2004 Ray et al.
2004/0056079 A1 3/2004 Srinivasan
2004/0144089 A1 7/2004 Kamen et al.
2004/0154252 A1 8/2004 Sypeck et al.
2004/0159985 A1 8/2004 Altoonian et al.
2005/0006047 A1 1/2005 Wang et al.
2005/0016706 A1 1/2005 Ray et al.
2005/0087319 A1 4/2005 Beals et al.
2005/0133193 A1 6/2005 Beals et al.
2005/0247429 A1 11/2005 Turkington et al.
2006/0032604 A1 2/2006 Beck et al.
2006/0048553 A1 3/2006 Almquist
2006/0065383 A1 3/2006 Ortiz et al.
2006/0107668 A1 5/2006 Cunha et al.
2006/0118262 A1 6/2006 Beals et al.
2006/0118990 A1 6/2006 Dierkes et al.
2006/0237163 A1 10/2006 Turkington et al.
2006/0283168 A1 12/2006 Humcke et al.
2007/0044936 A1 3/2007 Memmen
2007/0059171 A1 3/2007 Simms et al.
2007/0107412 A1 5/2007 Humcke et al.
2007/0114001 A1 5/2007 Snyder et al.
2007/0116972 A1 5/2007 Persky
2007/0169605 A1 7/2007 Szymanski
2007/0177975 A1 8/2007 Luczak et al.

(56) References Cited

U.S. PATENT DOCUMENTS

2007/0253816 A1 11/2007 Walz et al.
2008/0003849 A1 1/2008 Cherian
2008/0080979 A1 4/2008 Brassfield et al.
2008/0131285 A1 6/2008 Albert et al.
2008/0135718 A1 6/2008 Lee et al.
2008/0138208 A1 6/2008 Walters
2008/0138209 A1 6/2008 Cunha et al.
2008/0145235 A1 6/2008 Cunha et al.
2008/0169412 A1 7/2008 Snyder et al.
2008/0190582 A1 8/2008 Lee et al.
2009/0041587 A1 2/2009 Konter et al.
2009/0095435 A1 4/2009 Luczak et al.
2009/0181560 A1 7/2009 Cherian
2009/0255742 A1 10/2009 Hansen
2010/0021643 A1 1/2010 Lane et al.
2010/0150733 A1 6/2010 Abdel-Messeh et al.
2010/0200189 A1 8/2010 Qi et al.
2010/0219325 A1 9/2010 Bullied et al.
2010/0276103 A1 11/2010 Bullied et al.
2010/0304064 A1 12/2010 Huttner
2011/0048665 A1 3/2011 Schlienger et al.
2011/0068077 A1 3/2011 Smyth
2011/0132563 A1 6/2011 Merrill et al.
2011/0132564 A1 6/2011 Merrill et al.
2011/0135446 A1 6/2011 Dube et al.
2011/0146075 A1 6/2011 Hazel et al.
2011/0150666 A1 6/2011 Hazel et al.
2011/0189440 A1 8/2011 Appleby et al.
2011/0236221 A1 9/2011 Campbell
2011/0240245 A1 10/2011 Schlienger et al.
2011/0250078 A1 10/2011 Bruce et al.
2011/0250385 A1 10/2011 Sypeck et al.
2011/0293434 A1 12/2011 Lee et al.
2011/0315337 A1 12/2011 Piggush
2012/0161498 A1 6/2012 Hansen
2012/0163995 A1 6/2012 Wardle et al.
2012/0168108 A1 7/2012 Farris et al.
2012/0186681 A1 7/2012 Sun et al.
2012/0186768 A1 7/2012 Sun et al.
2012/0193841 A1 8/2012 Wang et al.
2012/0237786 A1 9/2012 Morrison et al.
2012/0276361 A1 11/2012 James et al.
2012/0298321 A1 11/2012 Smyth
2013/0019604 A1 1/2013 Cunha et al.
2013/0025287 A1 1/2013 Cunha
2013/0025288 A1 1/2013 Cunha et al.
2013/0064676 A1 3/2013 Salisbury et al.
2013/0139990 A1 6/2013 Appleby et al.
2013/0177448 A1 7/2013 Spangler
2013/0220571 A1 8/2013 Mueller et al.
2013/0266816 A1 10/2013 Xu
2013/0280093 A1 10/2013 Zelesky et al.
2013/0318771 A1 12/2013 Luczak et al.
2013/0323033 A1 12/2013 Lutjen et al.
2013/0327602 A1 12/2013 Barber et al.
2013/0333855 A1 12/2013 Merrill et al.
2013/0338267 A1 12/2013 Appleby et al.
2014/0023497 A1 1/2014 Giglio et al.
2014/0031458 A1 1/2014 Jansen
2014/0033736 A1 2/2014 Propheter-Hinckley et al.
2014/0068939 A1 3/2014 Devine, II et al.
2014/0076857 A1 3/2014 Hu et al.
2014/0076868 A1 3/2014 Hu et al.
2014/0093387 A1 4/2014 Pointon et al.
2014/0140860 A1 5/2014 Tibbott et al.
2014/0169981 A1 6/2014 Bales et al.
2014/0199177 A1 7/2014 Propheter-Hinckley et al.
2014/0202650 A1 7/2014 Song et al.
2014/0284016 A1 9/2014 Vander Wal
2014/0311315 A1 10/2014 Isaac
2014/0314581 A1 10/2014 McBrien et al.
2014/0342175 A1 11/2014 Morrison et al.
2014/0342176 A1 11/2014 Appleby et al.
2014/0356560 A1 12/2014 Prete et al.
2014/0363305 A1 12/2014 Shah et al.
2015/0053365 A1 2/2015 Mueller et al.
2015/0174653 A1 6/2015 Verner et al.
2015/0184857 A1 7/2015 Cunha et al.

FOREIGN PATENT DOCUMENTS

EP 0025481 B1 2/1983
EP 0111600 A1 6/1984
EP 0190114 A1 8/1986
EP 0319244 A2 6/1989
EP 0324229 A2 7/1989
EP 0324229 B1 7/1992
EP 0539317 A1 4/1993
EP 0556946 A1 8/1993
EP 0559251 A1 9/1993
EP 0585183 A1 3/1994
EP 0319244 B1 5/1994
EP 0661246 A1 7/1995
EP 0539317 B1 11/1995
EP 0715913 A1 6/1996
EP 0725606 A1 8/1996
EP 0750956 A2 1/1997
EP 0750957 A1 1/1997
EP 0792409 A1 9/1997
EP 0691894 B1 10/1997
EP 0805729 A2 11/1997
EP 0818256 A1 1/1998
EP 0556946 B1 4/1998
EP 0559251 B1 12/1998
EP 0585183 B1 3/1999
EP 0899039 A2 3/1999
EP 0750956 B1 5/1999
EP 0661246 B1 9/1999
EP 0725606 B1 12/1999
EP 0968062 A1 1/2000
EP 0805729 B1 8/2000
EP 1055800 A2 11/2000
EP 1070829 A2 1/2001
EP 1124509 A1 8/2001
EP 1142658 A1 10/2001
EP 1161307 A1 12/2001
EP 1163970 A1 12/2001
EP 1178769 A1 2/2002
EP 0715913 B1 4/2002
EP 0968062 B1 5/2002
EP 0951579 B1 1/2003
EP 1284338 A2 2/2003
EP 0750957 B1 3/2003
EP 1341481 A2 9/2003
EP 1358958 A1 11/2003
EP 1367224 A1 12/2003
EP 0818256 B1 2/2004
EP 1124509 B1 3/2004
EP 1425483 A2 6/2004
EP 1055800 B1 10/2004
EP 1163970 B1 3/2005
EP 1358958 B1 3/2005
EP 1519116 A1 3/2005
EP 1531019 A1 5/2005
EP 0899039 B1 11/2005
EP 1604753 A1 12/2005
EP 1659264 A2 5/2006
EP 1178769 B1 7/2006
EP 1382403 B1 9/2006
EP 1759788 A2 3/2007
EP 1764171 A1 3/2007
EP 1813775 A2 8/2007
EP 1815923 A1 8/2007
EP 1849965 A2 10/2007
EP 1070829 B1 1/2008
EP 1142658 B1 3/2008
EP 1927414 A2 6/2008
EP 1930097 A1 6/2008
EP 1930098 A1 6/2008
EP 1930099 A1 6/2008
EP 1932604 A1 6/2008
EP 1936118 A2 6/2008
EP 1939400 A2 7/2008
EP 1984162 A1 10/2008

(56) References Cited

FOREIGN PATENT DOCUMENTS

| | | | |
|---|---|---|---|
| EP | 1604753 | B1 | 11/2008 |
| EP | 2000234 | A2 | 12/2008 |
| EP | 2025869 | A1 | 2/2009 |
| EP | 1531019 | B1 | 3/2010 |
| EP | 2212040 | A1 | 8/2010 |
| EP | 2246133 | A1 | 11/2010 |
| EP | 2025869 | B1 | 12/2010 |
| EP | 2335845 | A1 | 6/2011 |
| EP | 2336493 | A2 | 6/2011 |
| EP | 2336494 | A2 | 6/2011 |
| EP | 1930097 | B1 | 7/2011 |
| EP | 2362822 | A2 | 9/2011 |
| EP | 2366476 | A1 | 9/2011 |
| EP | 2392774 | A1 | 12/2011 |
| EP | 1930098 | B1 | 2/2012 |
| EP | 2445668 | A2 | 5/2012 |
| EP | 2445669 | A2 | 5/2012 |
| EP | 2461922 | A1 | 6/2012 |
| EP | 1659264 | B1 | 11/2012 |
| EP | 2519367 | A2 | 11/2012 |
| EP | 2537606 | A1 | 12/2012 |
| EP | 1927414 | B1 | 1/2013 |
| EP | 2549186 | A2 | 1/2013 |
| EP | 2551592 | A2 | 1/2013 |
| EP | 2551593 | A2 | 1/2013 |
| EP | 2559533 | A2 | 2/2013 |
| EP | 2559534 | A2 | 2/2013 |
| EP | 2559535 | A2 | 2/2013 |
| EP | 2576099 | A1 | 4/2013 |
| EP | 2000234 | B1 | 7/2013 |
| EP | 2614902 | A2 | 7/2013 |
| EP | 2650062 | A2 | 10/2013 |
| EP | 2246133 | B1 | 7/2014 |
| EP | 2366476 | B1 | 7/2014 |
| EP | 2777841 | A1 | 9/2014 |
| EP | 1849965 | B1 | 2/2015 |
| EP | 2834031 | A2 | 2/2015 |
| EP | 1341481 | B1 | 3/2015 |
| EP | 2841710 | A1 | 3/2015 |
| EP | 2855857 | A2 | 4/2015 |
| EP | 2880276 | A1 | 6/2015 |
| EP | 2937161 | A1 | 10/2015 |
| GB | 731292 | A | 6/1955 |
| GB | 800228 | A | 8/1958 |
| GB | 2102317 | A | 2/1983 |
| GB | 2118078 | A | 10/1983 |
| JP | H1052731 | A | 2/1998 |
| WO | 9615866 | A1 | 5/1996 |
| WO | 9618022 | A1 | 6/1996 |
| WO | 2010036801 | A2 | 4/2010 |
| WO | 2010040746 | A1 | 4/2010 |
| WO | 2010151833 | A2 | 12/2010 |
| WO | 2010151838 | A2 | 12/2010 |
| WO | 2011019667 | A1 | 2/2011 |
| WO | 2013163020 | A1 | 10/2013 |
| WO | 2014011262 | A2 | 1/2014 |
| WO | 2014022255 | A1 | 2/2014 |
| WO | 2014028095 | A2 | 2/2014 |
| WO | 2014093826 | A2 | 6/2014 |
| WO | 2014105108 | A1 | 7/2014 |
| WO | 2014109819 | A1 | 7/2014 |
| WO | 2014133635 | A2 | 9/2014 |
| WO | 2014179381 | A1 | 11/2014 |
| WO | 2015006026 | A1 | 1/2015 |
| WO | 2015006440 | A1 | 1/2015 |
| WO | 2015006479 | A1 | 1/2015 |
| WO | 2015009448 | A1 | 1/2015 |
| WO | 2015042089 | A1 | 3/2015 |
| WO | 2015050987 | A1 | 4/2015 |
| WO | 2015053833 | A1 | 4/2015 |
| WO | 2015073068 | A1 | 5/2015 |
| WO | 2015073657 | A1 | 5/2015 |
| WO | 2015080854 | A1 | 6/2015 |
| WO | 2015094636 | A1 | 6/2015 |

OTHER PUBLICATIONS

European Search Report and Opinion issued in connection with related EP Application No. 16204609.8 dated May 12, 2017.
European Search Report and Opinion issued in connection with related EP Application No. 16204610.6 dated May 17, 2017.
European Search Report and Opinion issued in connection with corresponding EP Application No. 16204613.0 dated May 22, 2017.
European Search Report and Opinion issued in connection with related EP Application No. 16204605.6 dated May 26, 2017.
European Search Report and Opinion issued in connection with related EP Application No. 16204607.2 dated May 26, 2017.
European Search Report and Opinion issued in connection with related EP Application No. 16204608.0 dated May 26, 2017.
European Search Report and Opinion issued in connection with related EP Application No. 16204617.1 dated May 26, 2017.
European Search Report and Opinion issued in connection with related EP Application No. 16204614.8.0 dated Jun. 2, 2017.
U.S. Non Final Office Action issued in connection with Related U.S. Appl. No. 14/972,638 dated Apr. 27, 2016.
U.S. Final Office Action issued in connection with Related U.S. Appl. No. 14/972,638 dated Jul. 20, 2016.
U.S. Non Final Office Action issued in connection with Related U.S. Appl. No. 14/972,638 dated Nov. 23, 2016.
U.S. Final Office Action issued in connection with Related U.S. Appl. No. 14/972,638 dated Apr. 12, 2017.
European Search Report and Opinion issued in connection with related EP Application No. 16202422.8 dated May 8, 2017.
European Search Report and Opinion issued in connection with related EP Application No. 16204602.3 dated May 12, 2017.
European Search Report and Opinion issued in connection with related EP Application No. 16204613.0 dated Jun. 2, 2017.
European Search Report and Opinion issued in connection with corresponding EP Application No. 17168418.6 dated Aug. 10, 2017.
Liu et al, "Effect of nickel coating on bending properties of stereolithography photo-polymer SL5195", Materials & Design, vol. 26, Issue 6, pp. 493-496, 2005.
U.S. Appl. No. 14/972,413, filed Dec. 17, 2015, entitled Method and Assembly for Forming Components Having Internal Passages Using a Jacketed Core.
U.S. Appl. No. 14/972,645, filed Dec. 17, 2015, entitled Mold Assembly Including a Deoxygenated Core and Method of Making Same.
U.S. Appl. No. 14/973,595, filed Dec. 17, 2015, entitled Method and Assembly for Forming Components Having Internal Passages Using a Lattice Structure.
U.S. Appl. No. 14/972,805, filed Dec. 17, 2015, entitled Method and Assembly for Forming Components Having Internal Passages Using a Jacketed Core.
U.S. Appl. No. 14/972,390, filed Dec. 17, 2015, entitled Method and Assembly for Forming Components Having an Internal Passage Defined Therein.
U.S. Appl. No. 14/972,440, filed Dec. 17, 2015, entitled Method and Assembly for Forming Components Having an Internal Passage Defined Therein.
U.S. Appl. No. 14/973,590, filed Dec. 17, 2015, entitled Method and Assembly for Forming Components Having a Catalyzed Internal Passage Defined Therein.
U.S. Appl. No. 14/973,555, filed Dec. 17, 2015, entitled Method and Assembly for Forming Components Having an Internal Passage Defined Therein.
U.S. Appl. No. 14/973,250, filed Dec. 17, 2015, entitled Method and Assembly for Forming Components Having Internal Passages Using a Jacketed Core.
U.S. Appl. No. 14/973,501, filed Dec. 17, 2015, entitled Method and Assembly for Forming Components Having Internal Passages Using a Lattice Structure.
U.S. Appl. No. 14/972,638, filed Dec. 17, 2015, entitled Method and Assembly for Forming Components Having Internal Passages Using a Jacketed Core.
U.S. Appl. No. 14/973,039, filed Dec. 17, 2015, entitled Method and Assembly for Forming Components Having Internal Passages Using a Lattice Structure.

METHOD AND ASSEMBLY FOR FORMING COMPONENTS USING A JACKETED CORE

BACKGROUND

The field of the disclosure relates generally to components having an outer wall of a preselected thickness, and more particularly to forming such components using a jacketed core.

Some components require an outer wall to be formed with a preselected thickness, for example, in order to perform an intended function. For example, but not by way of limitation, some components, such as hot gas path components of gas turbines, are subjected to high temperatures. At least some such components have internal voids defined therein, such as but not limited to a network of plenums and passages, to receive a flow of a cooling fluid adjacent the outer wall, and an efficacy of the cooling provided is related to the thickness of the outer wall.

At least some known components having a preselected outer wall thickness are formed in a mold, with a core of ceramic material positioned within the mold cavity. A molten metal alloy is introduced around the ceramic core and cooled to form the component, and the outer wall of the component is defined between the ceramic core and an interior wall of the mold cavity. However, an ability to produce a consistent preselected outer wall thickness of the cast component depends on an ability to precisely position the core relative to the mold to define the cavity space between the core and the mold. For example, the core is positioned with respect to the mold cavity by a plurality of platinum locating pins. Such precise and consistent positioning, for example using the plurality of pins, is complex and labor-intensive in at least some cases, and leads to a reduced yield rate for successfully cast components, in particular for, but not limited to, cases in which a preselected outer wall thickness of the component is relatively thin. In addition, in at least some cases, the core and mold shift, shrink, and/or twist with respect to each other during the final firing before the casting pour, thereby altering the initial cavity space dimensions between the core and the mold and, consequently, the thickness of the outer wall of the cast component. Moreover, at least some known ceramic cores are fragile, resulting in cores that are difficult and expensive to produce and handle without damage during the complex and labor-intensive process.

Alternatively or additionally, at least some known components having a preselected outer wall thickness are formed by drilling and/or otherwise machining the component to obtain the outer wall thickness, such as, but not limited to, using an electrochemical machining process. However, at least some such machining processes are relatively time-consuming and expensive. Moreover, at least some such machining processes cannot produce an outer wall having the preselected thickness, shape, and/or curvature required for certain component designs.

BRIEF DESCRIPTION

In one aspect, a mold assembly for use in forming a component from a component material is provided. The component has an outer wall of a predetermined thickness. The mold assembly includes a mold that includes an interior wall that defines a mold cavity within the mold. The mold assembly also includes a jacketed core positioned with respect to the mold. The jacketed core includes a jacket. The jacket includes a first jacket outer wall coupled against the interior wall, a second jacket outer wall positioned interiorly from the first jacket outer wall, and at least one jacketed cavity defined therebetween. The at least one jacketed cavity is configured to receive the component material in a molten state therein. The jacketed core also includes a core positioned interiorly from the second jacket outer wall. The core includes a perimeter coupled against the second jacket outer wall. The jacket separates the perimeter from the interior wall by the predetermined thickness, such that the outer wall is formable therebetween the perimeter and the interior wall.

In another aspect, a method of forming a component having an outer wall of a predetermined thickness is provided. The method includes introducing a component material in a molten state into at least one jacketed cavity defined in a mold assembly. The mold assembly includes a jacketed core positioned with respect to a mold. The mold includes an interior wall that defines a mold cavity within the mold. The jacketed core includes a jacket that includes a first jacket outer wall coupled against the interior wall, a second jacket outer wall positioned interiorly from the first jacket outer wall, and the at least one jacketed cavity defined therebetween. The jacketed core also includes a core positioned interiorly from the second jacket outer wall. The core includes a perimeter coupled against the second jacket outer wall. The jacket separates the perimeter from the interior wall by the predetermined thickness. The method also includes cooling the component material to form the component. The perimeter and the interior wall cooperate to define the outer wall of the component therebetween.

DRAWINGS

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms such as "about," "approximately," and "substantially" is not to be limited to the precise value specified. In at least some instances, the approximating language may correspond to the precision of an instrument for measuring the value. Here and throughout the specification and claims, range limitations may be identified. Such ranges may be combined and/or interchanged, and include all the sub-ranges contained therein unless context or language indicates otherwise.

The exemplary components and methods described herein overcome at least some of the disadvantages associated with known assemblies and methods for forming a component having an outer wall of a predetermined thickness. The embodiments described herein include forming a precursor component shaped to correspond to a shape of at least portions of the component, and forming a jacket around the precursor component. A core is added to the jacketed precursor component, and the precursor component material is removed to form a jacketed core. Alternatively, the jacketed core includes a jacket formed without the precursor component, and/or a core formed in a separate core-forming process. The jacketed core is positioned with respect to a mold, and the component is cast in at least one jacketed cavity defined between jacket outer walls, such that the jacket separates a perimeter of the core from an interior wall of the mold by the predetermined thickness. When molten component material is added to the mold, the core perimeter and mold interior wall cooperate to define the outer wall of the component therebetween.

Figure 1:
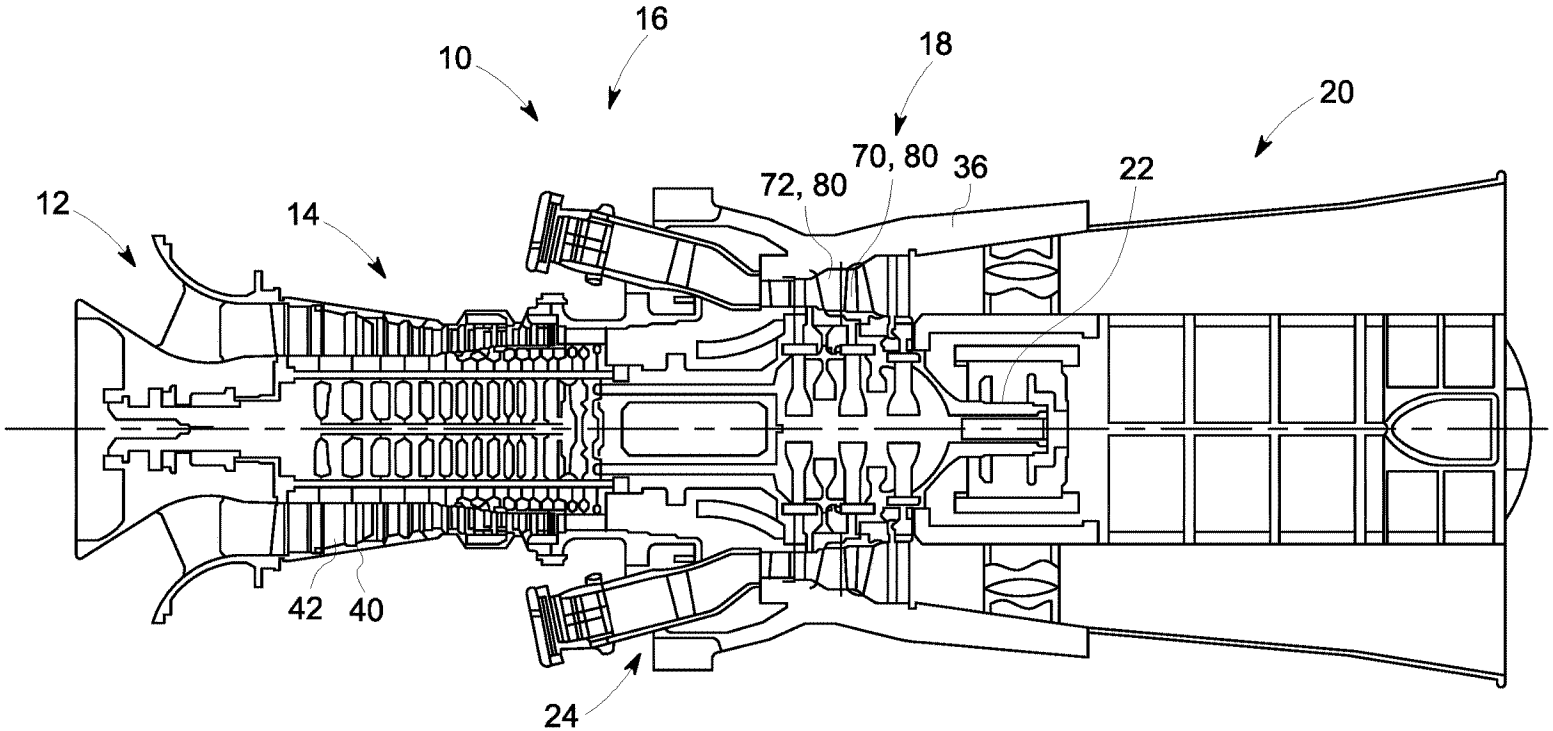
FIG. 1 is a schematic diagram of an exemplary rotary machine.

FIG. 1 is a schematic view of an exemplary rotary machine 10 having components for which embodiments of the current disclosure may be used. In the exemplary embodiment, rotary machine 10 is a gas turbine that includes an intake section 12, a compressor section 14 coupled downstream from intake section 12, a combustor section 16 coupled downstream from compressor section 14, a turbine section 18 coupled downstream from combustor section 16, and an exhaust section 20 coupled downstream from turbine section 18. A generally tubular casing 36 at least partially encloses one or more of intake section 12, compressor section 14, combustor section 16, turbine section 18, and exhaust section 20. In alternative embodiments, rotary machine 10 is any rotary machine for which components formed with internal passages as described herein are suitable. Moreover, although embodiments of the present disclosure are described in the context of a rotary machine for purposes of illustration, it should be understood that the embodiments described herein are applicable in any context that involves a component suitably formed with a preselected outer wall thickness.

In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components.

During operation of gas turbine 10, intake section 12 channels air towards compressor section 14. Compressor section 14 compresses the air to a higher pressure and temperature. More specifically, rotor shaft 22 imparts rotational energy to at least one circumferential row of compressor blades 40 coupled to rotor shaft 22 within compressor section 14. In the exemplary embodiment, each row of compressor blades 40 is preceded by a circumferential row of compressor stator vanes 42 extending radially inward from casing 36 that direct the air flow into compressor blades 40. The rotational energy of compressor blades 40 increases a pressure and temperature of the air. Compressor section 14 discharges the compressed air towards combustor section 16.

In combustor section 16, the compressed air is mixed with fuel and ignited to generate combustion gases that are channeled towards turbine section 18. More specifically, combustor section 16 includes at least one combustor 24, in which a fuel, for example, natural gas and/or fuel oil, is injected into the air flow, and the fuel-air mixture is ignited to generate high temperature combustion gases that are channeled towards turbine section 18.

Turbine section 18 converts the thermal energy from the combustion gas stream to mechanical rotational energy. More specifically, the combustion gases impart rotational energy to at least one circumferential row of rotor blades 70 coupled to rotor shaft 22 within turbine section 18. In the exemplary embodiment, each row of rotor blades 70 is preceded by a circumferential row of turbine stator vanes 72 extending radially inward from casing 36 that direct the combustion gases into rotor blades 70. Rotor shaft 22 may be coupled to a load (not shown) such as, but not limited to, an electrical generator and/or a mechanical drive application. The exhausted combustion gases flow downstream from turbine section 18 into exhaust section 20. Components of rotary machine 10 are designated as components 80. Components 80 proximate a path of the combustion gases are subjected to high temperatures during operation of rotary machine 10. Additionally or alternatively, components 80 include any component suitably formed with a preselected outer wall thickness.

Figure 2:
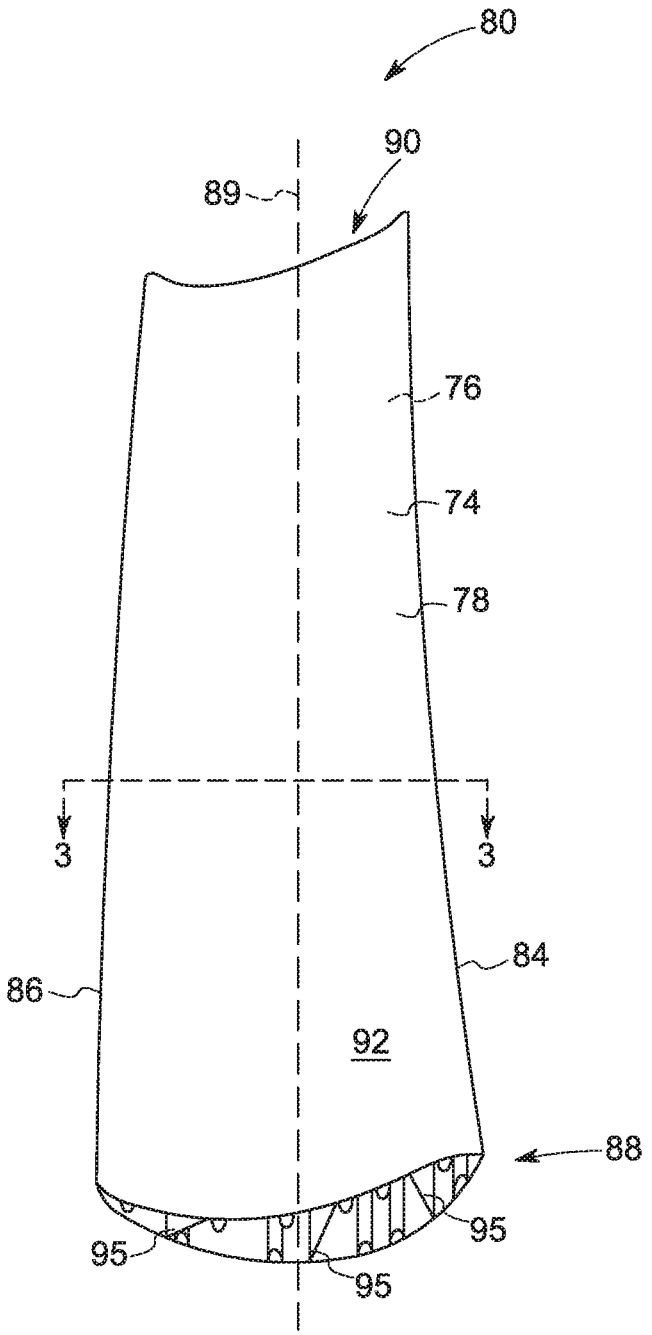
FIG. 2 is a schematic perspective view of an exemplary component for use with the rotary machine shown in FIG. 1.
Figure 3:
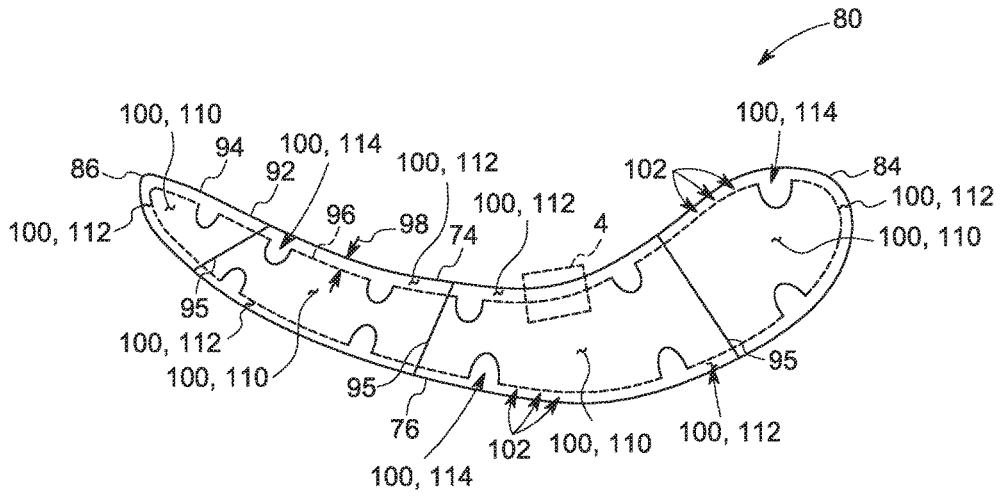
FIG. 3 is a schematic cross-section of the component shown in FIG. 2, taken along lines 3-3 shown in FIG. 2.
Figure 4:
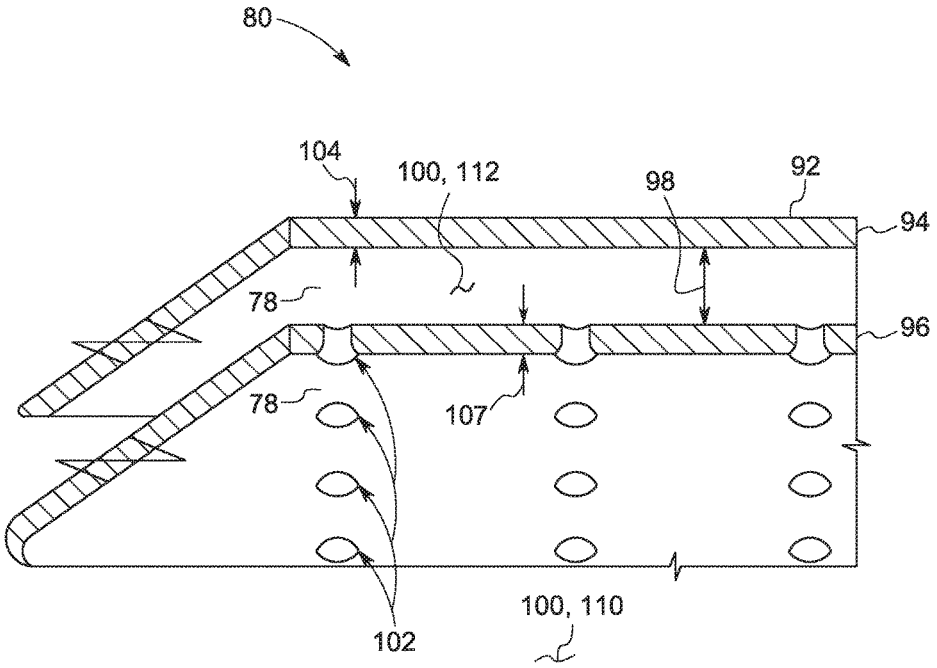
FIG. 4 is a schematic perspective sectional view of a portion of the component shown in FIGS. 2 and 3, designated as portion 4 in FIG. 3.

FIG. 2 is a schematic perspective view of an exemplary component 80, illustrated for use with rotary machine 10 (shown in FIG. 1). FIG. 3 is a schematic cross-section of component 80, taken along lines 3-3 shown in FIG. 2. FIG. 4 is a schematic perspective sectional view of a portion of component 80, designated as portion 4 in FIG. 3. With reference to FIGS. 2-4, component 80 includes an outer wall 94 having a preselected thickness 104. Moreover, in the exemplary embodiment, component 80 includes at least one internal void 100 defined therein. For example, a cooling fluid is provided to internal void 100 during operation of rotary machine 10 to facilitate maintaining component 80 below a temperature of the hot combustion gases.

Component 80 is formed from a component material 78. In the exemplary embodiment, component material 78 is a suitable nickel-based superalloy. In alternative embodiments, component material 78 is at least one of a cobalt-based superalloy, an iron-based alloy, and a titanium-based alloy. In other alternative embodiments, component material 78 is any suitable material that enables component 80 to be formed as described herein.

In the exemplary embodiment, component 80 is one of rotor blades 70 or stator vanes 72. In alternative embodiments, component 80 is another suitable component of rotary machine 10 that is capable of being formed with a preselected outer wall thickness as described herein. In still other embodiments, component 80 is any component for any suitable application that is suitably formed with a preselected outer wall thickness.

In the exemplary embodiment, rotor blade 70, or alternatively stator vane 72, includes a pressure side 74 and an opposite suction side 76. Each of pressure side 74 and suction side 76 extends from a leading edge 84 to an opposite trailing edge 86. In addition, rotor blade 70, or alternatively stator vane 72, extends from a root end 88 to an opposite tip end 90. A longitudinal axis 89 of component 80 is defined between root end 88 and tip end 90. In alternative embodiments, rotor blade 70, or alternatively stator vane 72, has any suitable configuration that is capable of being formed with a preselected outer wall thickness as described herein.

Outer wall 94 at least partially defines an exterior surface 92 of component 80. In the exemplary embodiment, outer wall 94 extends circumferentially between leading edge 84 and trailing edge 86, and also extends longitudinally between root end 88 and tip end 90. In alternative embodiments, outer wall 94 extends to any suitable extent that enables component 80 to function for its intended purpose. Outer wall 94 is formed from component material 78.

In addition, in certain embodiments, component 80 includes an inner wall 96 having a preselected thickness 107. Inner wall 96 is positioned interiorly to outer wall 94, and the at least one internal void 100 includes at least one plenum 110 that is at least partially defined by inner wall 96 and interior thereto. In the exemplary embodiment, each plenum 110 extends from root end 88 to proximate tip end 90. In alternative embodiments, each plenum 110 extends within component 80 in any suitable fashion, and to any suitable extent, that enables component 80 to be formed as described herein. In the exemplary embodiment, the at least one plenum 110 includes a plurality of plenums 110, each defined by inner wall 96 and at least one partition wall 95 that extends between pressure side 74 and suction side 76. In alternative embodiments, the at least one internal void 100 includes any suitable number of plenums 110 defined in any suitable fashion. Inner wall 96 is formed from component material 78.

Moreover, in some embodiments, at least a portion of inner wall 96 extends circumferentially and longitudinally adjacent at least a portion of outer wall 94 and is separated therefrom by an offset distance 98, such that the at least one internal void 100 also includes at least one chamber 112 defined between inner wall 96 and outer wall 94. In the exemplary embodiment, the at least one chamber 112 includes a plurality of chambers 112 each defined by outer wall 94, inner wall 96, and at least one partition wall 95. In alternative embodiments, the at least one chamber 112 includes any suitable number of chambers 112 defined in any suitable fashion. In the exemplary embodiment, inner wall 96 includes a plurality of apertures 102 defined therein and extending therethrough, such that each chamber 112 is in flow communication with at least one plenum 110.

In the exemplary embodiment, offset distance 98 is selected to facilitate effective impingement cooling of outer wall 94 by cooling fluid supplied through plenums 110 and emitted through apertures 102 defined in inner wall 96. For example, but not by way of limitation, offset distance 98 varies circumferentially and/or longitudinally along component 80 to facilitate local cooling requirements along respective portions of outer wall 94. In alternative embodiments, component 80 is not configured for impingement cooling, and offset distance 98 is selected in any suitable fashion.

In certain embodiments, the at least one internal void 100 further includes at least one return channel 114 at least partially defined by inner wall 96. Each return channel 114 is in flow communication with at least one chamber 112, such that each return channel 114 provides a return fluid flow path for fluid used for impingement cooling of outer wall 94. In the exemplary embodiment, each return channel 114 extends from root end 88 to proximate tip end 90. In alternative embodiments, each return channel 114 extends within component 80 in any suitable fashion, and to any suitable extent, that enables component 80 to be formed as described herein. In the exemplary embodiment, the at least one return channel 114 includes a plurality of return channels 114, each defined by inner wall 96 adjacent one of chambers 112. In alternative embodiments, the at least one return channel 114 includes any suitable number of return channels 114 defined in any suitable fashion.

For example, in some embodiments, cooling fluid is supplied to plenums 110 through root end 88 of component 80. As the cooling fluid flows generally towards tip end 90, portions of the cooling fluid are forced through apertures 102 into chambers 112 and impinge upon outer wall 94. The used cooling fluid then flows into return channels 114 and flows generally toward root end 88 and out of component 80. In some such embodiments, the arrangement of the at least one plenum 110, the at least one chamber 112, and the at least one return channel 114 forms a portion of a cooling circuit of rotary machine 10, such that used cooling fluid is returned to a working fluid flow through rotary machine 10 upstream of combustor section 16 (shown in FIG. 1). Although impingement flow through plenums 110 and chambers 112 and return flow through channels 114 is described in terms of embodiments in which component 80 is rotor blade 70 and/or stator vane 72, it should be understood that this disclosure contemplates a circuit of plenums 110, chambers 112, and return channels 114 for any suitable component 80 of rotary machine 10, and additionally for any suitable component 80 for any other application suitable for closed circuit fluid flow through a component. Such embodiments provide an improved operating efficiency for rotary machine 10 as compared to cooling systems that exhaust used cooling fluid directly from component 80 into the working fluid within turbine section 18. In alternative embodiments, the at least one internal void 100 does not include return channels 114. For example, but not by way of limitation, outer wall 96 includes openings extending therethrough (not shown), and the cooling fluid is exhausted into the working fluid through the outer wall openings to facilitate film cooling of exterior surface 92. In other alternative embodiments, component 80 includes both return channels 114 and openings (not shown) extending through outer wall 94, a first portion of the cooling fluid is returned to a working fluid flow through rotary machine 10 upstream of combustor section 16 (shown in FIG. 1), and a second portion of the cooling fluid is exhausted into the working fluid through the outer wall openings to facilitate film cooling of exterior surface 92.

Although the at least one internal void 100 is illustrated as including plenums 110, chambers 112, and return channels 114 for use in cooling component 80 that is one of rotor blades 70 or stator vanes 72, it should be understood that in alternative embodiments, component 80 is any suitable component for any suitable application, and includes any suitable number, type, and arrangement of internal voids 100 that enable component 80 to function for its intended purpose.

With particular reference to FIG. 4, in certain embodiments, outer wall 94 has a thickness 104 preselected to facilitate impingement cooling of outer wall 94 with a reduced amount of cooling fluid flow as compared to components having thicker outer walls. In alternative embodiments, outer wall thickness 104 is any suitable thickness that enables component 80 to function for its intended purpose. In certain embodiments, outer wall thickness 104 varies along outer wall 94. In alternative embodiments, outer wall thickness 104 is constant along outer wall 94.

In some embodiments, apertures 102 each have a substantially circular cross-section. In alternative embodiments, apertures 102 each have a substantially ovoid cross-section. In other alternative embodiments, apertures 102 each have any suitable shape that enables apertures 102 to be function as described herein.

Figure 5:
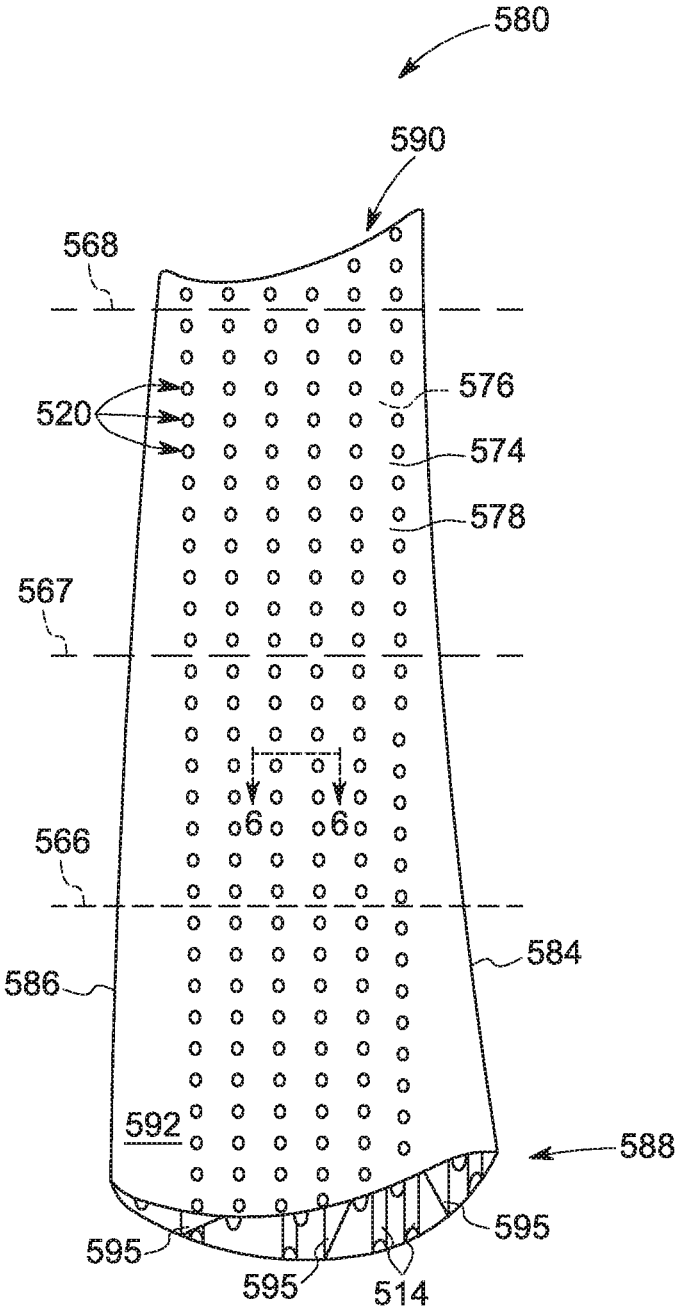
FIG. 5 is a schematic perspective view of an exemplary precursor component that may be used to form the component shown in FIGS. 2-4.
Figure 6:
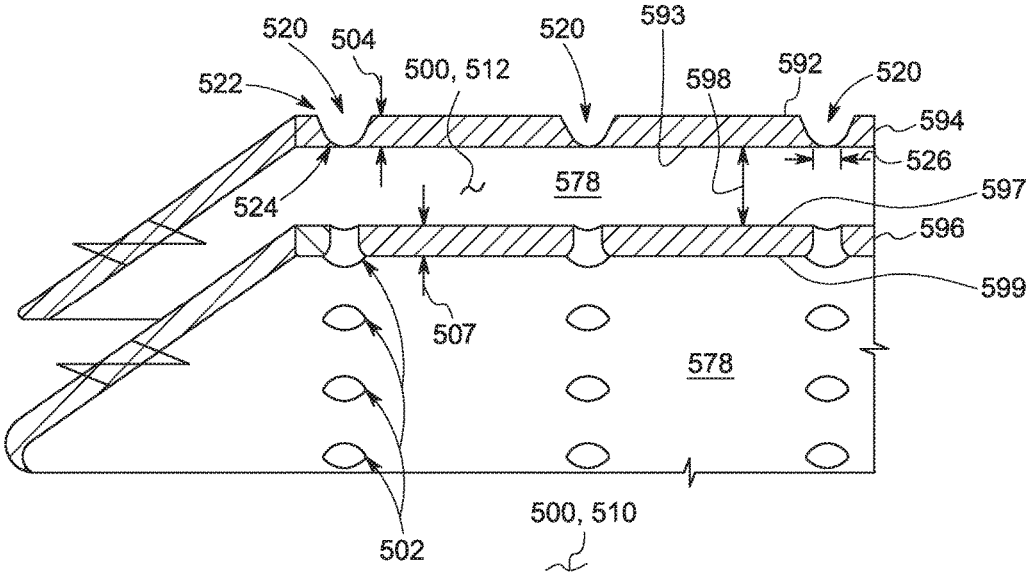
FIG. 6 is a schematic perspective sectional view of a portion of the exemplary precursor component shown in FIG. 5, taken along lines 6-6 in FIG. 5 and corresponding to the portion of the exemplary component shown in FIG. 4.

FIG. 5 is a schematic perspective view of an exemplary precursor component 580 that may be used to form component 80 shown in FIGS. 2-4. FIG. 6 is a schematic perspective sectional view of a portion of precursor component 580, taken along lines 6-6 in FIG. 5, and corresponding to the portion of component 80 shown in FIG. 4. With reference to FIGS. 2-6, precursor component 580 is formed from a precursor material 578 and has a shape corresponding to a shape of at least portions of component 80. More specifically, in certain embodiments, precursor component 580 has a shape corresponding to the shape of component 80, except an outer wall 594 of precursor component 580 includes at least one outer wall aperture 520 defined therein and extending therethrough. In other words, although outer wall 594 otherwise corresponds to the shape of outer wall 94 of component 80, the at least one outer wall aperture 520 does not correspond to a feature of outer wall 94 of component 80. In alternative embodiments, outer wall 94 includes openings extending therethrough (not shown), for example to facilitate film cooling of exterior surface 92 of component 80 as described above, and precursor component outer wall apertures 520 are positioned and shaped to correspond to the openings defined through outer wall 94. In other alternative embodiments, precursor component 580 does not include the at least one outer wall aperture 520.

Furthermore, in some embodiments, a thickness 504 of outer wall 594 is reduced relative to thickness 104 of outer wall 94 by twice a thickness 706 of a jacket 700 to be applied to outer wall 594, as will be described herein. Alternatively, thickness 504 is not reduced relative to thickness 104. Additionally, in some embodiments, a thickness 507 of inner wall 596 is reduced relative to thickness 107 of inner wall 96 by twice thickness 706 of jacket 700 to be applied to inner wall 596, as will be described herein. Alternatively, thickness 507 is not reduced relative to thickness 107.

For example, in the exemplary embodiment in which component 80 is one of rotor blades 70 or stator vanes 72 (shown in FIG. 1), precursor component 580 includes a pressure side 574 and an opposite suction side 576, a first end 588 and an opposite second end 590, and a leading edge 584 and an opposite trailing edge 586 shaped to correspond to pressure side 74, suction side 76, root end 88, tip end 90, leading edge 84, and trailing edge 86 of component 80.

In addition, precursor component 580 includes at least one internal void 500 that has a shape corresponding to the at least one void 100 of component 80. For example, in the exemplary embodiment, precursor component 580 includes at least one plenum 510, at least one chamber 512, and at least one return channel 514 corresponding to the at least one plenum 110, the at least one chamber 112, and the at least one return channel 114 of component 80. Moreover, precursor component 580 includes an inner wall 596 corresponding to inner wall 96 of component 80, and inner wall apertures 502 defined in inner wall 596 corresponding to apertures 102 of component 80. In alternative embodiments, inner wall 596 does not include inner wall apertures 502. For example, but not by way of limitation, component 80 is initially formed without inner wall apertures 102, and inner wall apertures 102 are added to component 80 in a subsequent process such as, but not limited to, mechanical drilling, electric discharge machining, or laser drilling. In some embodiments, precursor component 580 further includes at least one partition wall 595 that extends at least partially between pressure side 574 and suction side 576, corresponding to the at least one partition wall 95 of component 80. For example, in the illustrated embodiment, each partition wall 595 extends from outer wall 594 of pressure side 574 to outer wall 594 of suction side 576. In alternative embodiments, at least one partition wall 595 extends from inner wall 596 of pressure side 574 to inner wall 596 of suction side 576. Additionally or alternatively, at least one partition wall 595 extends from inner wall 596 to outer wall 594 of pressure side 574, and/or from inner wall 596 to outer wall 594 of suction side 576.

In addition, precursor component 580 includes outer wall 594 that at least partially defines an exterior surface 592 of precursor component 580. Inner wall 596 extends circumferentially and longitudinally adjacent at least a portion of outer wall 594 and is separated therefrom by an offset distance 598, corresponding to offset distance 98 of component 80. A shape of outer wall 594 and exterior surface 592 correspond to the shape of outer wall 94 and exterior surface 92 of component 80, except that, in the exemplary embodiment, outer wall 594 additionally includes the at least one outer wall aperture 520 defined therein and extending therethrough. In alternative embodiments in which outer wall 94 includes openings extending therethrough, as described above, outer wall apertures 520 correspond in location and shape to the openings extending through outer wall 94. In certain embodiments, the at least one outer wall aperture 520 facilitates forming at least one stand-off structure 720 (shown in FIG. 7) that facilitates maintaining an offset between a core 800 (shown in FIG. 8) and a mold 1000 (shown in FIG. 10) used to form component 80, as will be described herein. In alternative embodiments, precursor component 580 does not include outer wall apertures 520, and the at least one stand-off structure is formed by another suitable method, as will be described herein.

In alternative embodiments, component 80 is any suitable component for any suitable application, and precursor component 580 has a shape that corresponds to the shape of such component 80, except that in certain embodiments outer wall 594 includes at least one outer wall aperture 520 that does not correspond to a feature of outer wall 94 of component 80.

In the exemplary embodiment, outer wall apertures 520 each extend from a first end 522, defined in exterior surface 592, to a second end 524, defined in a second surface 593 of outer wall 594 opposite exterior surface 592. In certain embodiments, a diameter 526 of outer wall apertures 520 at second end 524 is selected to enable a jacket 700 (shown in FIG. 7) applied to outer wall 594 to form a closure 722 (shown in FIG. 7) at second end 524 of outer wall apertures 520, as will be described herein. Alternatively, diameter 526 of outer wall apertures 520 at first end 522 is selected to enable jacket 700 applied to outer wall 594 to form closure 722 at first end 522 of outer wall apertures 520. In the exemplary embodiment, outer wall apertures 520 each define a generally frusto-conical shape through outer wall 594. In alternative embodiments, each outer wall aperture 520 defines any suitable shape that enables outer wall apertures 520 to function as described herein. Closure 722 prevents an opening corresponding to aperture 520 from being formed in outer wall 94 when component 80 is formed. In alternative embodiments in which outer wall 94 includes openings extending therethrough, as described above, outer wall apertures 520 are sized to correspond to the openings such that closure 722 is not formed, enabling later formation of the openings extending through outer wall 94.

In some embodiments, precursor component 580 is formed at least partially using a suitable additive manufacturing process, and precursor material 578 is selected to facilitate additive manufacture of precursor component 580. For example, a computer design model of precursor component 580 is developed from a computer design model of component 80, with some embodiments including outer wall thickness 504 reduced and/or outer wall apertures 520 added, as described above, in the computer design model for precursor component 580. The computer design model for precursor component 580 is sliced into a series of thin, parallel planes between first end 588 and second end 590 of precursor component 580. A computer numerically controlled (CNC) machine deposits successive layers of precursor material 578 from first end 588 to second end 590 in accordance with the model slices to form precursor component 580. Three such representative layers are indicated as layers 566, 567, and 568.

In some such embodiments, precursor material 578 is selected to be a photopolymer, and the successive layers of precursor material 578 are deposited using a stereolithographic process. Alternatively, precursor material 578 is selected to be a thermoplastic, and the successive layers of precursor material 578 are deposited using at least one of a fused filament fabrication process, an inkjet/powder bed process, a selective heat sintering process, and a selective laser sintering process. Additionally or alternatively, precursor material 578 is selected to be any suitable material, and the successive layers of precursor material 578 are deposited using any suitable process that enables precursor component 580 to be formed as described herein. It should be understood that in certain embodiments, precursor component 580 is formed from a plurality of separately additively manufactured sections that are subsequently coupled together in any suitable fashion, as described generally herein with respect to FIG. 12.

In certain embodiments, the formation of precursor component 580 by an additive manufacturing process enables precursor component 580 to be formed with a nonlinearity, structural intricacy, precision, and/or repeatability that is not achievable by other methods. Accordingly, the formation of precursor component 580 by an additive manufacturing process enables the complementary formation of core 800 (shown in FIG. 8), and thus of component 80, with a correspondingly increased nonlinearity, structural intricacy, precision, and/or repeatability. Additionally or alternatively, the formation of precursor component 580 using an additive manufacturing process enables the formation of internal voids 500 that could not be reliably added to component 80 in a separate process after initial formation of component 80 in a mold. Moreover, in some embodiments, the formation of precursor component 580 by an additive manufacturing process using precursor material 578 that is a photopolymer or thermoplastic decreases a cost and/or a time required for manufacture of component 80, as compared to forming component 80 directly by additive manufacture using a metallic component material 78.

In alternative embodiments, precursor component 580 is formed in any suitable fashion that enables precursor component 580 to function as described herein. For example, but not by way of limitation, a suitable pattern material, such as wax, is injected into a suitable pattern die to form precursor component 580. Again, it should be understood that in certain embodiments, precursor component 580 is formed from a plurality of separately formed sections that are subsequently coupled together in any suitable fashion, as described generally herein with respect to FIG. 12.

Figure 7:
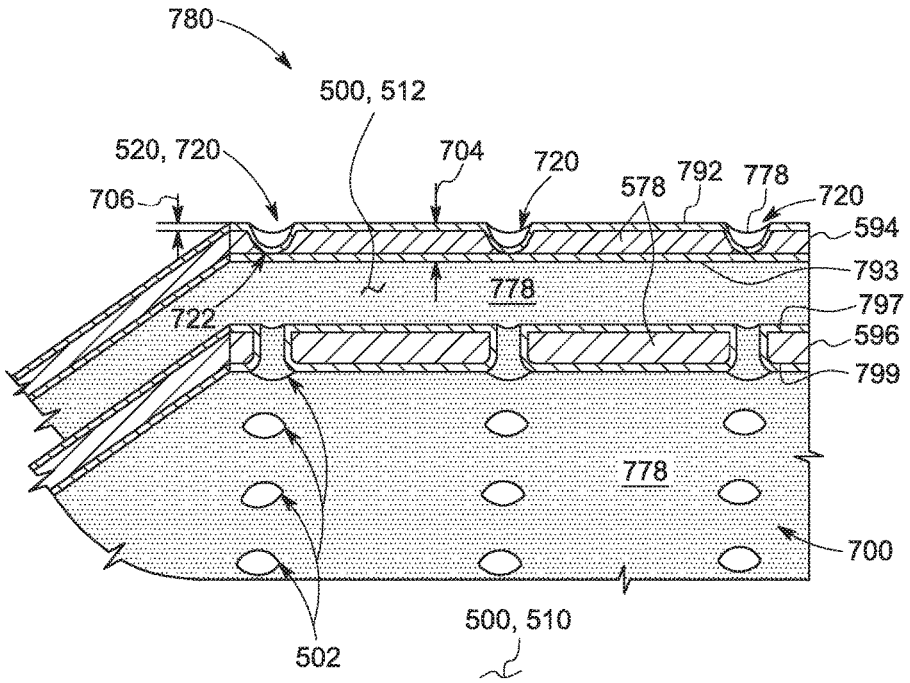
FIG. 7 is a schematic perspective sectional view of a portion of an exemplary jacketed precursor component that includes an exemplary jacket coupled to the exemplary precursor component shown in FIG. 6.

FIG. 7 is a schematic perspective sectional view of a portion of an exemplary jacketed precursor component 780 that includes an exemplary jacket 700 coupled to precursor component 580. With reference to FIGS. 4-7, in certain embodiments, jacket 700 includes at least one layer of a jacket material 778 adjacent at least a portion of a surface of precursor component 580. For example, in the exemplary embodiment, jacket 700 includes a first jacket outer wall 792 adjacent exterior surface 592, and a second jacket outer wall 793 adjacent opposing second surface 593 of outer wall 594, such that second jacket outer wall 793 is positioned interiorly from first jacket outer wall 792. Jacket outer walls 792 and 793 have shapes corresponding to exterior surface 592 and second surface 593, respectively, of precursor component outer wall 594. Moreover, jacket outer walls 792 and 793 are configured to separate a perimeter 806 of core 800 from an interior wall 1002 of a mold 1000 (shown in FIG. 11) used to form component 80 by thickness 104 of outer wall 94, as will be described herein.

For example, in the exemplary embodiment, first jacket outer wall 792 includes jacket material 778 adjacent outer wall apertures 520, such that first jacket outer wall 792 locally couples against second jacket outer wall 793 at second end 524 of outer wall apertures 520. In alternative embodiments in which diameter 526 of outer wall apertures 520 at first end 522 is selected to such that closure 722 is formed at first end 522 of outer wall apertures 520, first jacket outer wall 792 locally couples against second jacket outer wall 793 at first end 522 of outer wall apertures 520. Each jacketed outer wall aperture 520 defines a respective stand-off structure 720 of jacket 700 that is configured to separate perimeter 806 from interior wall 1002 by thickness 104. Jacket outer walls 792 and 793 cooperate to define a respective closure 722 at either first end 522 or second end 524 of each outer wall aperture 520, and closure 722 further defines the corresponding stand-off structure 720. In alternative embodiments in which outer wall 94 includes openings extending therethrough, as described above, outer wall apertures 520 are sized to correspond to the openings in outer wall 94 such that closure 722 is not formed as part of stand-off structure 720.

More specifically, first jacket outer wall 792 and second jacket outer wall 793 are separated at locations other than proximate stand-off structures 720 by thickness 504 of outer wall 594. In certain embodiments, as discussed above, thickness 504 of outer wall 594 is reduced relative to thickness 104 of outer wall 94 by twice thickness 706 of jacket 700, such that a combined thickness 704 of first jacket outer wall 792, second jacket outer wall 793, and outer wall 594 corresponds to thickness 104 of outer wall 94 of component 80. Alternatively, thickness 504 is not reduced relative to thickness 104, and thickness 706 of jacket 700 is relatively small compared to thickness 504, such that combined thickness 704 of first jacket outer wall 792, second jacket outer wall 793, and outer wall 594 approximately corresponds to thickness 104 of outer wall 94 of component 80. Similarly, in certain embodiments, as discussed above, thickness 507 of inner wall 596 is reduced relative to thickness 107 of inner wall 96 by twice thickness 706 of jacket 700, such that a combined thickness of a first jacket inner wall 797, a second jacket inner wall 799, and inner wall 596 corresponds to thickness 107 of inner wall 96 of component 80. Alternatively, thickness 507 is not reduced relative to thickness 107, and thickness 706 of jacket 700 is relatively small compared to thickness 507, such that combined thickness of first jacket inner wall 797, second jacket inner wall 799, and inner wall 596 approximately corresponds to thickness 107 of inner wall 96 of component 80.

In alternative embodiments, the at least one stand-off structure 720 has any suitable structure. For example, but not by way of limitation, the at least one stand-off structure 720 is formed as a lattice between jacket outer walls 792 and 793, such as by forming outer wall apertures 520 of precursor component 580 as intersecting channels. For another example, but not by way of limitation, precursor component 580 does not include outer wall apertures 520. In some such embodiments, jacket outer walls 792 and 793 are locally coupled together using a metal stamp (not shown) that locally collapses outer wall 594, such that first jacket outer wall 792 locally couples against second jacket outer wall 793 to form a respective stand-off structure 720. First jacket outer wall 792 and second jacket outer wall 793 are separated at locations other than proximate stand-off structure 720 by thickness 504 of outer wall 594 and, thus, to thickness 104 of outer wall 94 of component 80. In some other such embodiments, jacket outer walls 792 and 793 are locally coupled together using a metal rivet (not shown) that locally collapses outer wall 594, such that first jacket outer wall 792 is locally coupled to second jacket outer wall 793 to form a respective stand-off structure 720. First jacket outer wall 792 and second jacket outer wall 793 are separated at locations other than proximate stand-off structure 720 by thickness 504 of outer wall 594 and, thus, combined thickness 704 at least approximately corresponds to thickness 104 of outer wall 94 of component 80, as described above. In other alternative embodiments, jacket 700 is configured to separate perimeter 806 from interior wall 1002 (shown in FIG. 11) by thickness 104 in any suitable fashion that enables jacket 700 to function as described herein.

Also in the exemplary embodiment, jacket material 778 is adjacent opposing surfaces 597 and 599 of inner wall 596 to form opposing jacket inner walls 797 and 799 positioned interiorly from second jacket outer wall 793. Further in the exemplary embodiment, jacket material 778 is adjacent inner wall 596 adjacent inner wall apertures 502, such that inner wall apertures 502 jacketed by jacket material 778 extend through inner wall 596. Moreover, in certain embodiments, jacketed precursor component 780 continues to define the at least one internal void 500 that has a shape corresponding to the at least one void 100 of component 80. For example, in the exemplary embodiment, jacketed precursor component 780 includes at least one plenum 510, at least one chamber 512, and at least one return channel 514 (shown in FIG. 5). In some embodiments, jacket 700 further is adjacent opposing surfaces of partition walls 595 (shown in FIG. 5). Additionally or alternatively, jacket 700 is adjacent any suitable portion of the surface of precursor component 580 that enables jacketed precursor component 780 to function as described herein.

In the exemplary embodiment, jacket 700 has a substantially uniform thickness 706. In alternative embodiments, thickness 706 varies over at least some portions of jacket 700. In certain embodiments, thickness 706 is selected to be small relative to outer wall thickness 504. In some embodiments, thickness 706 also is selected such that stand-off structures 720 and/or other portions of jacket 700 provide at least a minimum selected structural stiffness such that combined thickness 704 defined by first jacket outer wall 792 and second jacket outer wall 793 is maintained when precursor material 578 is not positioned therebetween, as will be described herein.

In certain embodiments, jacket material 778 is selected to be at least partially absorbable by molten component material 78. For example, component material 78 is an alloy, and jacket material 778 is at least one constituent material of the alloy. Moreover, in some embodiments, jacket material 778 includes a plurality of materials disposed on precursor component 580 in successive layers, as will be described herein.

Figure 10:
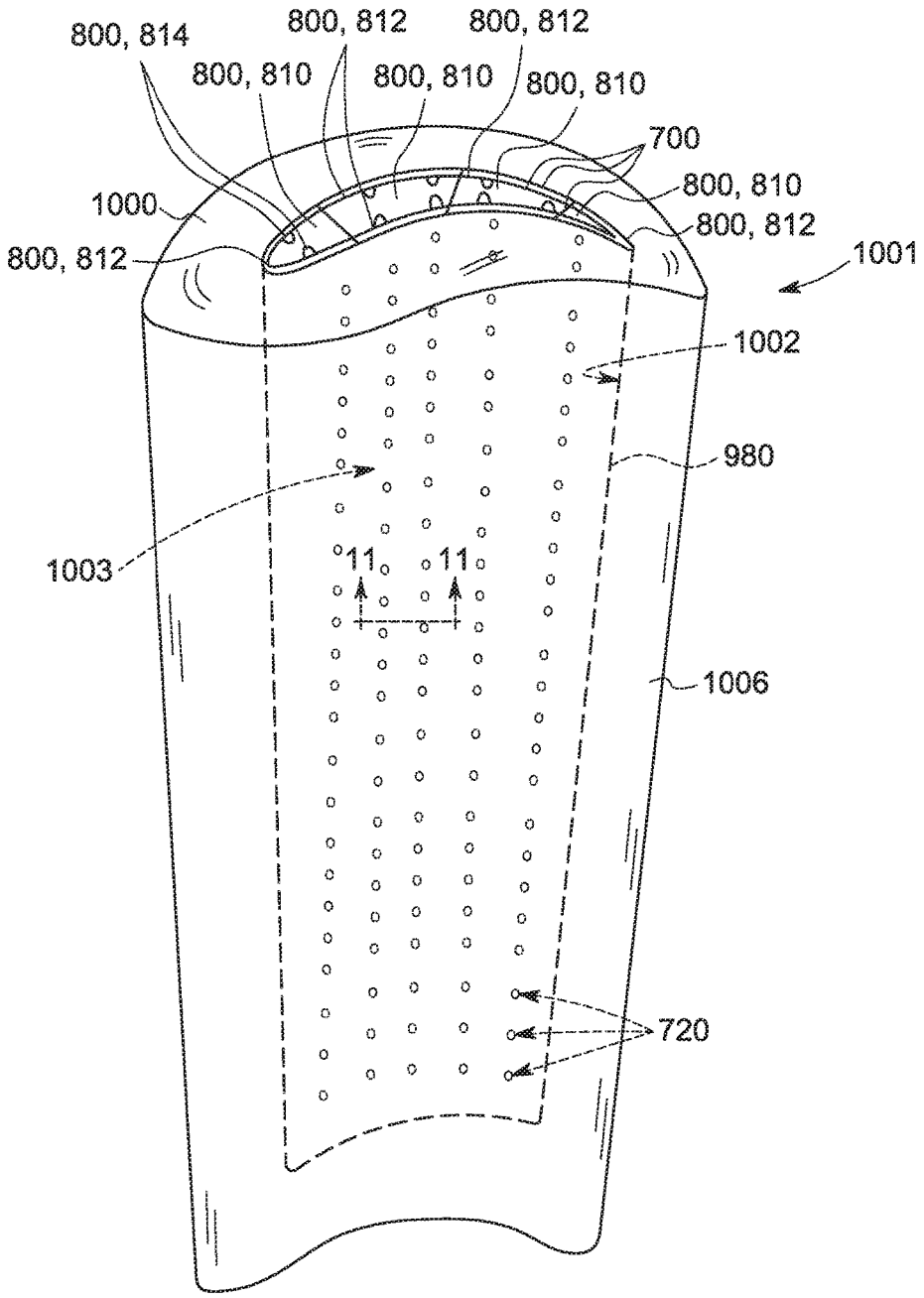
FIG. 10 is a schematic perspective view of an exemplary mold assembly that includes the exemplary jacketed core shown in FIG. 9 and that may be used to form the exemplary component shown in FIGS. 2-4.

For example, in the exemplary embodiment, component material 78 is a nickel-based superalloy, and jacket material 778 is substantially nickel, such that jacket material 778 is compatible with component material 78 when component material 78 in the molten state is introduced into mold 1000 (shown in FIG. 10). In alternative embodiments, component material 78 is any suitable alloy, and jacket material 778 is at least one material that is compatible with the molten alloy. For example, component material 78 is a cobalt-based superalloy, and jacket material 778 is substantially cobalt. For another example, component material 78 is an iron-based alloy, and jacket material 778 is substantially iron. For another example, component material 78 is a titanium-based alloy, and jacket material 778 is substantially titanium.

In certain embodiments, thickness 706 is sufficiently thin such that jacket material 778 is substantially absorbed by component material 78 when component material 78 in the molten state is introduced into mold 1000. For example, in some such embodiments, jacket material 778 is substantially absorbed by component material 78 such that no discrete boundary delineates jacket material 778 from component material 78 after component material 78 is cooled. Moreover, in some such embodiments, jacket 700 is substantially absorbed such that, after component material 78 is cooled, jacket material 778 is substantially uniformly distributed within component material 78. For example, a concentration of jacket material 778 proximate core 800 (shown in FIG. 8) is not detectably higher than a concentration of jacket material 778 at other locations within component 80. For example, and without limitation, jacket material 778 is nickel and component material 78 is a nickel-based superalloy, and no detectable higher nickel concentration remains proximate core 800 after component material 78 is cooled, resulting in a distribution of nickel that is substantially uniform throughout the nickel-based superalloy of formed component 80.

In alternative embodiments, thickness 706 is selected such that jacket material 778 is other than substantially absorbed by component material 78. For example, in some embodiments, jacket material 778 is partially absorbed by component material 78, such that after component material 78 is cooled, jacket material 778 is other than substantially uniformly distributed within component material 78. For example, a concentration of jacket material 778 proximate core 800 is detectably higher than a concentration of jacket material 778 at other locations within component 80. In some such embodiments, jacket material 778 is insubstantially absorbed, that is, at most only slightly absorbed, by component material 78 such that a discrete boundary delineates jacket material 778 from component material 78 after component material 78 is cooled. Additionally or alternatively, in some such embodiments, jacket material 778 is insubstantially absorbed, that is, at most only slightly absorbed, by component material 78 such that at least a portion of jacket 700 proximate core 800 and/or at least a portion of jacket 700 proximate interior wall 1002 remains intact after component material 78 is cooled.

In some embodiments, jacket 700 is formed on at least a portion of the surface of precursor component 580 by a plating process, such that jacket material 778 is deposited on precursor component 580 until the selected thickness 706 of jacket 700 is achieved. For example, jacket material 778 is a metal, and is deposited on precursor component 580 in a suitable metal plating process. In some such embodiments, jacket material 778 is deposited on precursor component 580 in an electroless plating process. Additionally or alternatively, jacket material 778 is deposited on precursor component 580 in an electroplating process. In alternative embodiments, jacket material 778 is any suitable material, and jacket 700 is formed on precursor component 580 by any suitable plating process that enables jacket 700 to function as described herein.

In certain embodiments, jacket material 778 includes a plurality of materials disposed on precursor component 580 in successive layers. For example, precursor material 578 is a thermoplastic, an initial layer of jacket material 778 is a first metal alloy selected to facilitate electroless plating deposition onto precursor material 578, and a subsequent layer of jacket material 778 is a second metal alloy selected to facilitate electroplating to the prior layer of jacket material 778. In some such embodiments, each of the first and second metal alloys are alloys of nickel. In other embodiments, precursor material 578 is any suitable material, jacket material 778 is any suitable plurality of materials, and jacket 700 is formed on precursor component 580 by any suitable process that enables jacket 700 to function as described herein.

Figure 12:
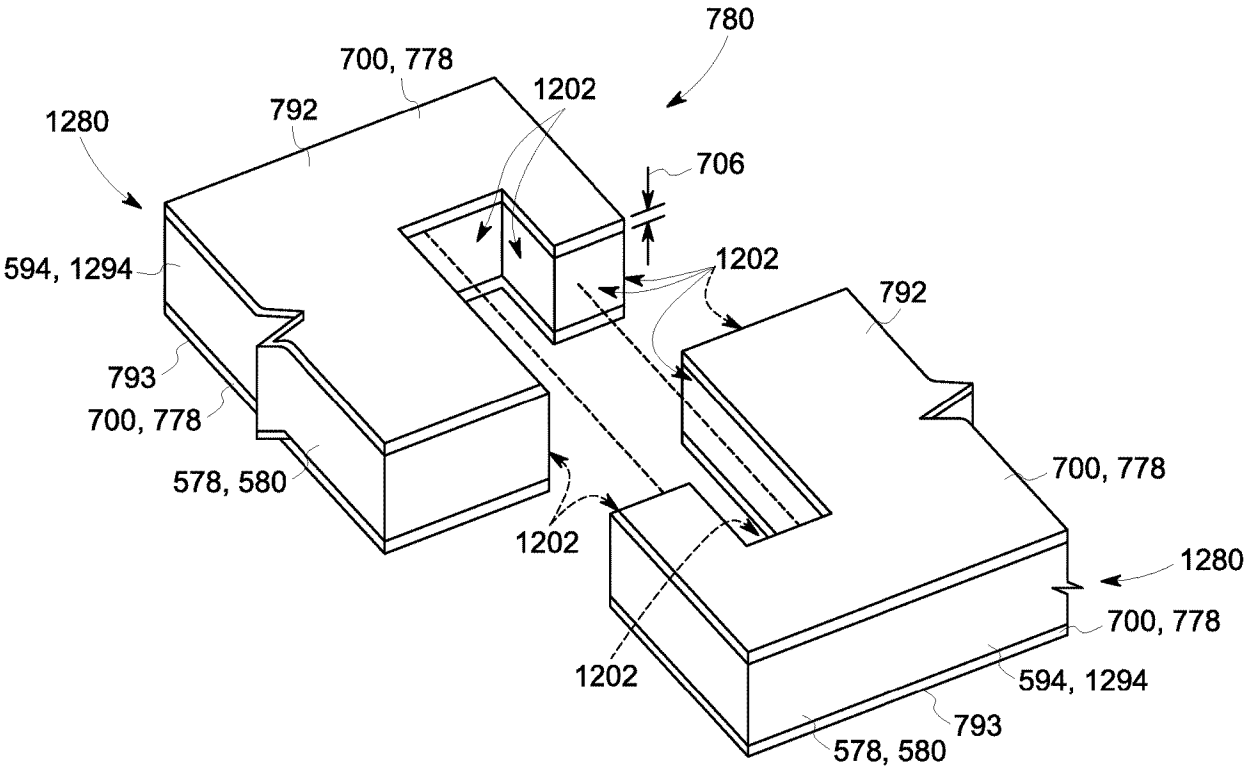
FIG. 12 is a schematic perspective exploded view of a portion of another exemplary jacketed precursor component that may be used to form the component shown in FIG. 2.

In certain embodiments, jacketed precursor component 780 is formed from a unitary precursor component 580. In alternative embodiments, jacketed precursor component 780 is formed from a precursor component 580 that is other than unitarily formed. For example, FIG. 12 is a schematic perspective exploded view of a portion of another exemplary jacketed precursor component 780 that may be used to form component 80 shown in FIG. 2. In the illustrated embodiment, jacketed precursor component 780 includes precursor component 580 formed from a plurality of separately formed sections 1280 coupled together.

More specifically, in the illustrated embodiment, each precursor component section 1280 includes an outer wall section 1294, and the plurality of outer wall sections 1294 are configured to couple together at a plurality of mating surfaces 1202 to form precursor component outer wall 594. Jacket material 778 is applied to each outer wall section 1294 to form outer walls 792 and 793 of jacket 700. In certain embodiments, jacket material 778 is not applied to mating surfaces 1202. For example, in some embodiments, jacket material 778 is applied to each precursor component section 1280 in a plating process as described above, and a masking material is first applied to each mating surface 1202 to inhibit deposition of jacket material 778 on mating surfaces 1202. In alternative embodiments, application of jacket material 778 to mating surfaces 1202 is inhibited using any suitable method. Moreover, in some embodiments, application of jacket material 778 is similarly inhibited on other selected surfaces of precursor component 580 in addition to, or alternatively from, mating surfaces 1202.

In some embodiments, but not by way of limitation, formation of precursor component 580 and jacketed precursor component 780 from a plurality of separately formed and jacketed precursor component sections 1280 facilitates precise and/or repeatable application of jacket 700 to selected areas of precursor components 580 that have a relatively increased structural complexity. As one example, in some embodiments, one of internal voids 500 (shown in FIG. 7) defines an internal pipe bounded by specified portions of precursor component inner wall 596 and/or partition walls 595. The internal pipe extends to a depth within precursor component 580 for which a selected plating process would not be effective to reliably deposit jacket 700 on the specified portions of precursor component inner wall 596 and/or partition walls 595 of a unitary precursor component 580. Instead, precursor component 580 includes a pair of separately formed "half-pipe" sections such that the specified portions of precursor component inner wall 596 and/or partition walls 595 are exposed along their full depth, and each half-pipe section is separately plated with jacket 700 prior to coupling the sections together to form jacketed precursor component 780. Furthermore, in some such embodiments, masking of mating surfaces 1202 during application of jacket material 778 facilitates coupling together jacketed precursor component sections 1280. In alternative embodiments, jacket 700 is formed on the assembled precursor component 580 subsequent to coupling together of the sections of precursor component 580.

In certain embodiments, after pre-jacketed sections 1280 are coupled together, and/or unjacketed sections 1280 are coupled together and jacket 700 is applied to the coupled-together sections, to form jacketed precursor component 780, jacketed cored precursor component 880 (shown in FIG. 8) is formed by filling the at least one internal void 500 of jacketed precursor component 780 with a core material 878 and firing to cure core 800, as described below. In alternative embodiments, core 800 is formed from core material 878 and fired in a separate core-forming process, and jacketed sections 1280 are coupled around core 800 to form jacketed cored precursor component 880.

Returning to FIG. 7, in alternative embodiments, jacket 700 is formed in any suitable fashion. For example, jacket 700 is formed using a process that does not involve precursor component 580. In some such embodiments, jacket 700 is formed at least partially using a suitable additive manufacturing process, and jacket material 778 is selected to facilitate additive manufacture of jacket 700. For example, a computer design model of jacket 700 is developed from a computer design model of component 80, with preselected thickness 706 of jacket 700 added in the computer design model adjacent selected surfaces of component 80 and stand-off structures 720 added at selected locations within outer wall 94, as described above, and then component 80 itself is removed from the computer design model. The computer design model for jacket 700 is sliced into a series of thin, parallel planes, and a computer numerically controlled (CNC) machine deposits successive layers of jacket material 778 from a first end to a second end of jacket 700 in accordance with the model slices to form jacket 700. In some embodiments, the successive layers of jacket material 778 are deposited using at least one of a direct metal laser melting (DMLM) process, a direct metal laser sintering (DMLS) process, and a selective laser sintering (SLS) process. Additionally or alternatively, jacket 700 is formed using another suitable additive manufacturing process. It should be understood that in certain embodiments, jacket 700 is formed from a plurality of separately additively manufactured sections that are subsequently coupled together, such as around a separately formed core 800, in any suitable fashion.

In certain embodiments, the formation of jacket 700 by an additive manufacturing process enables jacket 700 to be formed with a nonlinearity, structural intricacy, precision, and/or repeatability that is not achievable by other methods. Accordingly, the formation of jacket 700 by an additive manufacturing process enables the complementary formation of core 800 (shown in FIG. 8), and thus of component 80, with a correspondingly increased nonlinearity, structural intricacy, precision, and/or repeatability. Additionally or alternatively, the formation of jacket 700 using an additive manufacturing process enables the formation of internal voids 500 that could not be reliably added to component 80 in a separate process after initial formation of component 80 in a mold. Moreover, in some embodiments, the formation of jacket 700 by an additive manufacturing process decreases a cost and/or a time required for manufacture of component 80, as compared to forming component 80 directly by additive manufacture using component material 78.

Figure 8:
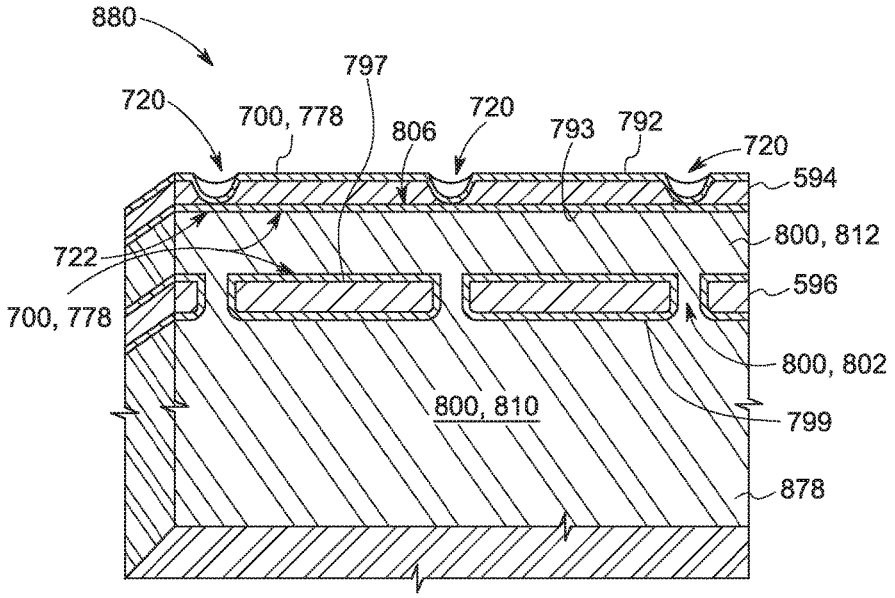
FIG. 8 is a schematic perspective sectional view of a portion of an exemplary jacketed cored precursor component that includes an exemplary core within the jacketed precursor component shown in FIG. 7.

FIG. 8 is a schematic perspective sectional view of a portion of an exemplary jacketed cored precursor component 880 that includes exemplary core 800 within jacketed precursor component 780. More specifically, core 800 is positioned interiorly from second jacket outer wall 793, such that perimeter 806 of core 800 is coupled against second jacket outer wall 793. Thus, core 800 is located within the at least one internal void 500 of jacketed precursor component 780. For example, in the exemplary embodiment, core 800 includes at least one plenum core portion 810, at least one chamber core portion 812, and at least one return channel core portion 814 (shown in FIG. 10) positioned respectively in the at least one plenum 510, the at least one chamber 512, and the at least one return channel 514 of jacketed precursor component 780. The at least one plenum core portion 810, the at least one chamber core portion 812, and the at least one return channel core portion 814 are configured to define, respectively, the at least one plenum 110, the at least one chamber 112, and the at least one return channel 114 when component 80 is formed. Further in the exemplary embodiment, core 800 includes inner wall aperture core portions 802 positioned in inner wall apertures 502 of jacketed precursor component 780, and inner wall aperture core portions 802 are configured to define inner wall apertures 102 when component 80 is formed. In other alternative embodiments, inner wall 596 does not include inner wall apertures 502, and core 800 correspondingly does not include core portions 802. For example, as described above, component 80 is initially formed without inner wall apertures 102, and inner wall apertures 102 are added to component 80 in a subsequent process.

Core 800 is formed from a core material 878. In the exemplary embodiment, core material 878 is a refractory ceramic material selected to withstand a high temperature environment associated with the molten state of component material 78 used to form component 80. For example, but without limitation, core material 878 includes at least one of silica, alumina, and mullite. Moreover, in the exemplary embodiment, core material 878 is selectively removable from component 80 to form the at least one internal void 100. For example, but not by way of limitation, core material 878 is removable from component 80 by a suitable process that does not substantially degrade component material 78, such as, but not limited to, a suitable chemical leaching process. In certain embodiments, core material 878 is selected based on a compatibility with, and/or a removability from, component material 78. Additionally or alternatively, core material 878 is selected based on a compatibility with jacket material 778. For example, in some such embodiments, core material 878 is selected to have a matched thermal expansion coefficient to that of jacket material 778, such that during core firing, core 800 and jacket 700 expand at the same rate, thereby reducing or eliminating stresses, cracking, and/or other damaging of the core due to mismatched thermal expansion. In alternative embodiments, core material 878 is any suitable material that enables component 80 to be formed as described herein.

In some embodiments, jacketed cored precursor component 880 is formed by filling the at least one internal void 500 of jacketed precursor component 780 with core material 878. For example, but not by way of limitation, core material 878 is injected as a slurry into plenums 510, chambers 512, apertures 502, and return channels 514, and core material 878 is then dried and fired within jacketed precursor component 780 to form core 800. In alternative embodiments, an alternative refractory material, such as but not limited to a segment of a quartz rod (not shown), is inserted into inner wall apertures 502 prior to injection of core material 878, and the alternative refractory material forms core portions 802. In certain embodiments, use of the alternative refractory material to form core portions 802 avoids a risk of cracking of core material 878 in a small-hole geometry of portions 802. In some embodiments, closures 722 at second end 524 prevent core material 878 from entering into stand-off structures 720 or otherwise flowing outside of outer wall 594. In some alternative embodiments in which closure 722 is formed at first end 522 of outer wall apertures 520, a filler material (not shown) is added to jacket outer wall 793 at each stand-off structure 720 prior to formation of core 800. More specifically, similar to filler material 1008 as described below, the filler material is inserted into each stand-off structure 720 such that a shape of second jacket outer wall 793 corresponds to the interior shape of component outer wall 94 proximate stand-off structures 720. For example, but not by way of limitation, the filler material is a wax material. In some such embodiments, the filler material is removed from mold 1000 as slag after molten component material 78 is introduced into the at least one jacketed cavity 900. In some such embodiments, the filler material facilitates preventing core material 878 from entering into stand-off structures 720 when core 800 is formed. Alternatively, the filler material is not used and core material 878 is allowed to penetrate to some extent into stand-off structures 720. In other alternative embodiments in which outer wall 94 includes openings extending therethrough, as described above, closures 722 are not present, enabling core material 878 to flow into outer wall apertures 520 to define the openings through outer wall 594.

In alternative embodiments, core 800 is formed and positioned in any suitable fashion that enables core 800 to function as described herein. For example, but not by way of limitation, core material 878 is injected as a slurry into a suitable core die (not shown), dried, and fired in a separate core-forming process to form core 800. In some such embodiments, for example, sections of jacketed precursor component 580 are coupled around the separately formed core 800 to form jacketed cored precursor component 880. In other such embodiments, for example, sections of jacket 700 are decoupled from, or formed without using, precursor component 580, and the sections of jacket 700 are coupled around the separately formed core 800 to form jacketed core 980. In still other embodiments, for example, jacket 700 is decoupled from, or formed without using, precursor component 580, and core material 878 is added as a slurry to jacket 700 and fired within jacket 700 to form core 800 within jacketed core 980.

Figure 9:
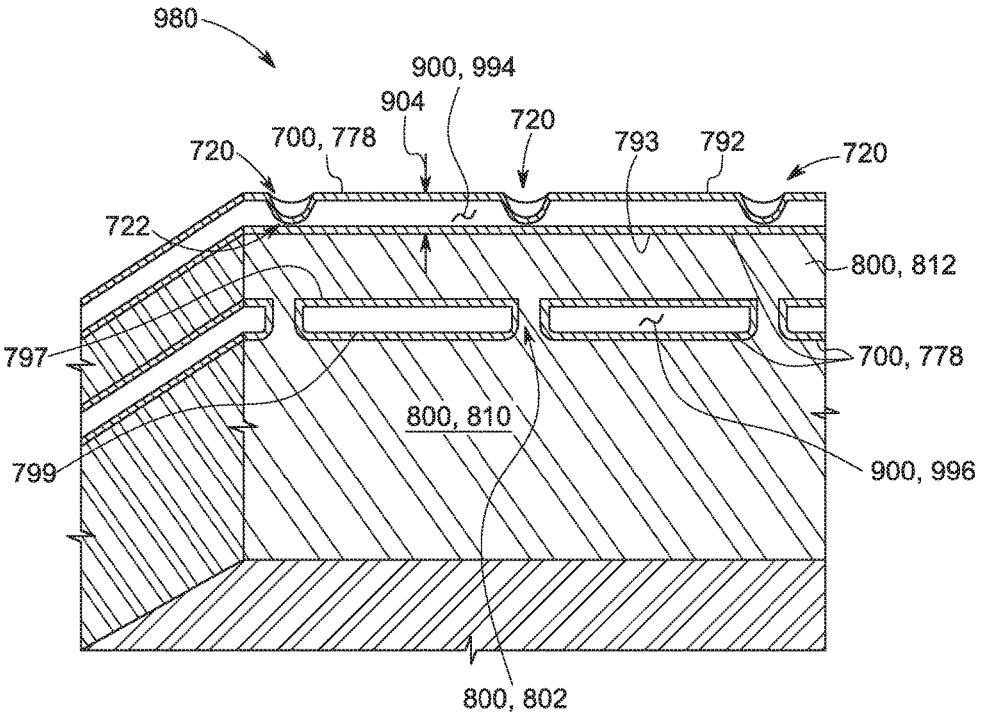
FIG. 9 is a schematic perspective sectional view of a portion of an exemplary jacketed core that includes portions of the exemplary jacketed cored precursor component shown in FIG. 8 other than the precursor component shown in FIG. 5.

FIG. 9 is a schematic perspective sectional view of a portion of an exemplary jacketed core 980 that includes portions of jacketed cored precursor component 880 other than precursor component 580. In certain embodiments, jacketed core 980 is formed by removing precursor component 580 from jacketed cored precursor component 880, for example by oxidizing or "burning out" precursor material 578 from jacketed cored precursor component 880. For example, in the exemplary embodiment, precursor component outer wall 594, precursor component inner wall 596, and precursor partition walls 595 are removed from jacketed cored precursor component 880 to form jacketed core 980. In alternative embodiments, jacketed core 980 is formed from jacket 700 that is first decoupled from, or formed without using, precursor component 580, as described above.

Jacketed core 980 defines at least one jacketed cavity 900 therewithin. Each at least one jacketed cavity 900 is configured to receive molten component material 78 therein to form a corresponding portion of component 80. More specifically, molten component material 78 is added to the at least one jacketed cavity 900 and cooled, such that component material 78 and jacket material 778 bounded by core 800 and/or interior wall 1002 at least partially define the corresponding portion of component 80, as will be described herein.

In the exemplary embodiment, first jacket outer wall 792 and second jacket outer wall 793 define at least one jacketed cavity 900, designated as at least one outer wall jacketed cavity 994, therebetween. As discussed above, jacket 700 separates perimeter 806 from interior wall 1002 of mold 1000 (shown in FIG. 11) by thickness 104 of component outer wall 94 (shown in FIG. 4). For example, in the exemplary embodiment, stand-off structures 720 have sufficient stiffness such that a combined thickness 904 of first jacket outer wall 792, second jacket outer wall 793, and outer wall jacketed cavity 994 corresponds to combined thickness 704 of first jacket outer wall 792, second jacket outer wall 793, and precursor component outer wall 594, and thus corresponds to thickness 104 of component outer wall 94. Thus, a shape of the at least one outer wall jacketed cavity 994 corresponds to a shape of outer wall 94 of component 80 at locations other than proximate stand-off structures 720.

Similarly, opposing jacket inner walls 797 and 799 define at least one inner wall jacketed cavity 996 therebetween. Because jacket inner walls 797 and 799 define a shape that corresponds to a shape of inner wall 96 of component 80, a shape of plenum core portion 810 around the boundary of the at least one inner wall jacketed cavity 996 corresponds to a shape of inner wall 96 of component 80. Moreover, in some embodiments, the opposing jacket partition walls corresponding to component partition walls 95 define at least one partition wall jacketed cavity (not shown) therebetween.

In alternative embodiments, jacketed core 980 defines the at least one jacketed cavity 900 having a shape corresponding to any suitable portion of component 80 for use in any suitable application.

In certain embodiments, precursor material 578 is selected to facilitate removal of precursor component 580 from within jacketed cored precursor component 880 to form jacketed core 980. In some such embodiments, precursor material 578 is selected to have an oxidation or auto-ignition temperature that is less than a melting point of jacket material 778. For example, a temperature of jacketed precursor component 780 is raised to or above the oxidation temperature of precursor material 578, such that precursor component 580 is oxidized or burned out of jacket 700. Moreover, in some such embodiments, precursor component 580 is oxidized at least partially simultaneously with a firing of core 800 within jacketed cored precursor component 880. Alternatively, precursor material 578 is oxidized and/or otherwise removed prior to firing core 800 within jacketed cored precursor component 880. Additionally or alternatively, precursor material 578 is melted and drained from within jacketed cored precursor component 880.

Additionally or alternatively, precursor material 578 is selected to be a softer material than jacket material 778, and precursor component 580 is machined out of jacketed precursor component 780. For example, a mechanical rooter device is snaked into jacket 700 to break up and/or dislodge precursor material 578 to facilitate removal of precursor component 580. Additionally or alternatively, precursor material 578 is selected to be compatible with a chemical removal process, and precursor component 580 is removed from jacket 700 using a suitable solvent.

In alternative embodiments, precursor material 578 is any suitable material that enables precursor component 580 to be removed from within jacketed precursor component 780 in any suitable fashion. In other alternative embodiments, jacket 700 is formed by a process that does not include any use of precursor component 580, as described above, such that no precursor material 578 needs to be removed to form jacketed core 980.

In the exemplary embodiment, core 800 includes, as described above, the at least one plenum core portion 810 positioned interiorly from second jacket inner wall 799, the at least one chamber core portion 812 positioned between first jacket inner wall 797 and second jacket outer wall 793, and inner wall aperture core portions 802 extending through the at least one inner wall jacketed cavity 996. In some embodiments, core 800 also includes the at least one return channel core portion 814 (shown in FIG. 10). In certain embodiments, jacket 700 provides a skeleton structure within jacketed core 980 that facilitates positioning the plurality of portions of core 800 with respect to each other and, subsequently, with respect to mold 1000 (shown in FIG. 10).

In alternative embodiments, core 800 is configured to correspond to any other suitable configuration of the at least one internal void 100 that enables component 80 to function for its intended purpose.

In certain embodiments, jacket 700 structurally reinforces core 800, thus reducing potential problems that would be associated with production, handling, and use of an unreinforced core 800 to form component 80 in some embodiments. For example, in certain embodiments, core 800 is a relatively brittle ceramic material subject to a relatively high risk of fracture, cracking, and/or other damage. Thus, in some such embodiments, forming and transporting jacketed core 980 presents a much lower risk of damage to core 800, as compared to using an unjacketed core 800. Similarly, in some such embodiments, forming a suitable mold 1000 (shown in FIG. 10) around jacketed core 980, such as by repeated investment of jacketed core 980 in a slurry of mold material, presents a much lower risk of damage to jacketed core 980, as compared to using an unjacketed core 800. Thus, in certain embodiments, use of jacketed core 980 presents a much lower risk of failure to produce an acceptable component 80, as compared to forming component 80 using an unjacketed core 800.

Figure 11:
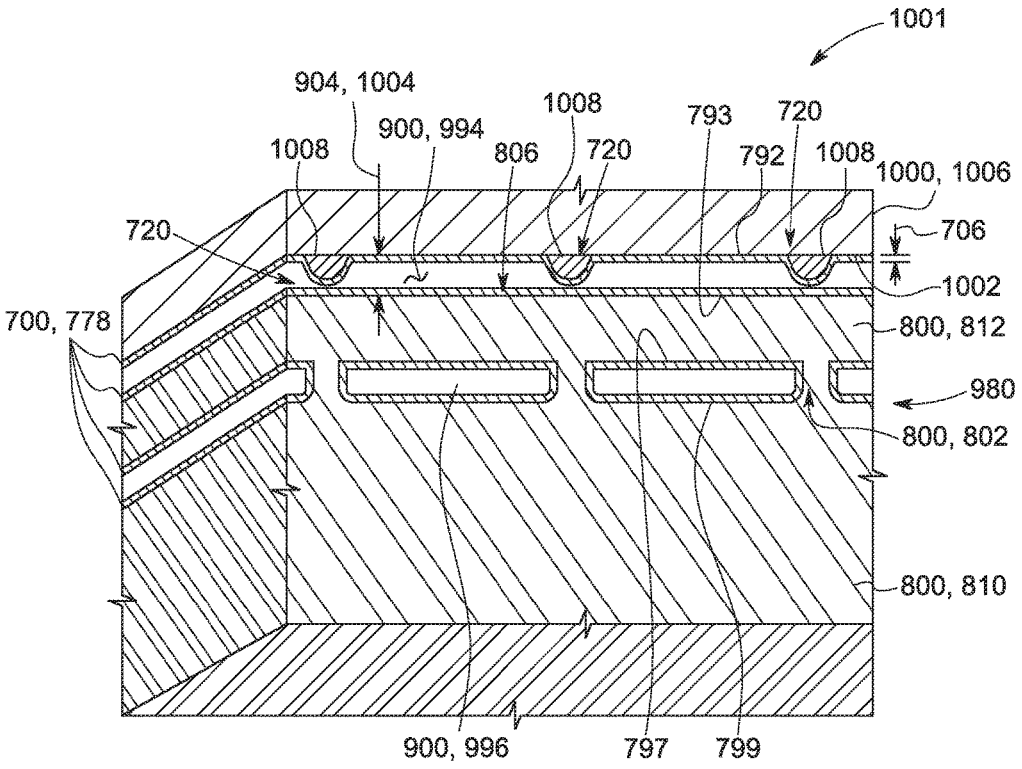
FIG. 11 is a schematic perspective sectional view of a portion of the mold assembly shown in FIG. 10, taken along lines 11-11 in FIG. 10, and including the portion shown in FIG. 9 of the exemplary jacketed core shown in FIG. 9.

FIG. 10 is a schematic perspective view of an exemplary mold assembly 1001 that includes jacketed core 980 and may be used to form component 80 shown in FIGS. 2-4. FIG. 11 is a schematic perspective sectional view of a portion of mold assembly 1001, taken along lines 11-11 in FIG. 10, and including the portion of jacketed core 980 shown in FIG. 9. With reference to FIGS. 2-4, 10, and 11, mold assembly 1001 includes jacketed core 980 positioned with respect to mold 1000. An interior wall 1002 of mold 1000 defines a mold cavity 1003 within mold 1000, and jacketed core 980 is at least partially received in mold cavity 1003. More specifically, interior wall 1002 defines a shape corresponding to an exterior shape of component 80, such that first jacket outer wall 792, which also has a shape corresponding to the exterior shape of component 80 at locations other than proximate stand-off structures 720, is coupled against interior wall 1002.

In addition, jacket 700 separates core perimeter 806 from interior wall 1002 by thickness 104 of component outer wall 94, as discussed above, such that molten component material 78 is receivable within at least one jacketed cavity 900 defined between jacket outer walls 792 and 793 to form outer wall 94 having preselected thickness 104. More specifically, in the exemplary embodiment, the at least one stand-off structure 720 maintains combined thickness 904 of first jacket outer wall 792, second jacket outer wall 793, and outer wall jacketed cavity 994 at locations other than proximate stand-off structures 720. Thus, when first jacket outer wall 792 is coupled against interior wall 1002, stand-off structures 720 position perimeter 806 of the at least one chamber core portion 812 with respect to interior wall 1002 at an offset distance 1004 that corresponds to combined thickness 904, which in turn corresponds to thickness 104 of outer wall 94 of component 80. The at least one outer wall jacketed cavity 994 is configured to receive molten component material 78, such that core perimeter 806 adjacent the at least one outer wall jacketed cavity 994 cooperates with interior wall 1002 of mold 1000 to define outer wall 94 of component 80 having thickness 104. Jacket material 778 adjacent the at least one outer wall jacketed cavity 994 and component material 78, collectively bounded by core perimeter 806 and mold interior wall 1002, form outer wall 94. In some embodiments, for example, jacket material 778 of jacket outer walls 792 and 793 is substantially absorbed by molten component material 78 to form outer wall 94, while in other embodiments, for example, jacket outer walls 792 and 793 remain at least partially intact adjacent component material 78 within outer wall 94, as described above.

Moreover, as described above, core 800 is shaped to correspond to a shape of at least one internal void 100 of component 80, such that core 800 of jacketed core 980 positioned within mold cavity 1003 defines the at least one internal void 100 within component 80 when component 80 is formed. For example, in the exemplary embodiment, the at least one inner wall jacketed cavity 996 is configured to receive molten component material 78, such that the at least one plenum core portion 810, the at least one chamber core portion 812, and/or the inner wall aperture core portions 802 adjacent the at least one inner wall jacketed cavity 996 cooperate to define inner wall 96 of component 80. Jacket material 778 adjacent the at least one inner wall jacketed cavity 996 and component material 78, collectively bounded by the at least one plenum core portion 810, the at least one chamber core portion 812, and the inner wall aperture core portions 802, form inner wall 96. In some embodiments, for example, jacket material 778 of jacket inner walls 797 and 799 is substantially absorbed by molten component material 78 to form inner wall 96, while in other embodiments, for example, jacket inner walls 797 and 799 remain at least partially intact adjacent component material 78 within inner wall 96, as described above.

The at least one plenum core portion 810 defines the at least one plenum 110 interiorly of inner wall 96, the at least one chamber core portion 812 defines the at least one chamber 112 between inner wall 96 and outer wall 94, and the inner wall aperture core portions 802 define inner wall apertures 102 extending through inner wall 96. Moreover, in some embodiments, the at least one return channel core portion 814 defines the at least one return channel 114 at least partially defined by inner wall 96.

After component material 78 is cooled in the at least one jacketed cavity 900 to form component 80, core 800 is removed from component 80 to form the at least one internal void 100. For example, but not by way of limitation, core material 878 is removed from component 80 using a chemical leaching process.

It should be recalled that, although component 80 in the exemplary embodiment is rotor blade 70, or alternatively stator vane 72, in alternative embodiments component 80 is any component suitably formable with an outer wall as described herein and for use in any application.

Mold 1000 is formed from a mold material 1006. In the exemplary embodiment, mold material 1006 is a refractory ceramic material selected to withstand a high temperature environment associated with the molten state of component material 78 used to form component 80. In alternative embodiments, mold material 1006 is any suitable material that enables component 80 to be formed as described herein. Moreover, in the exemplary embodiment, mold 1000 is formed by a suitable investment process. For example, but not by way of limitation, jacketed core 980 is repeatedly dipped into a slurry of mold material 1006 which is allowed to harden to create a shell of mold material 1006, and the shell is fired to form mold 1000. In alternative embodiments, mold 1000 is formed by any suitable method that enables mold 1000 to function as described herein.

In some embodiments, a filler material 1008 is added to jacket outer wall 792 at each stand-off structure 720 prior to formation of mold 1000 around jacketed core 980. More specifically, filler material 1008 is inserted into each stand-off structure 720 such that a shape of first jacket outer wall 792 corresponds to the exterior shape of component 80 proximate stand-off structures 720. For example, but not by way of limitation, filler material 1008 is a wax material. In some such embodiments, filler material 1008 is removed from mold 1000 as slag after molten component material 78 is introduced into the at least one jacketed cavity 900. In certain embodiments, filler material 1008 facilitates preventing stand-off structures 720 from forming bumps on interior wall 1002 when mold 1000 is formed around jacketed core 980.

In certain embodiments, after first jacket outer wall 792 is coupled against interior wall 1002, jacketed core 980 is secured relative to mold 1000 such that core 800 remains fixed relative to mold 1000 during a process of forming component 80. For example, jacketed core 980 is secured such that a position of core 800 does not shift during introduction of molten component material 78 into the at least one jacketed cavity 900. In some embodiments, external fixturing (not shown) is used to secure jacketed core 980 relative to mold 1000. Additionally or alternatively, jacketed core 980 is secured relative to mold 1000 in any other suitable fashion that enables the position of core 800 relative to mold 1000 to remain fixed during a process of forming component 80.

In some embodiments, the use of jacketed core 980 including the at least one stand-off structure 720 to position perimeter 806 of core 800 at offset distance 1004 from interior wall 1002, as compared to other methods such as, but not limited to, a use of platinum locating pins, enables an improved precision and/or repeatability in forming of outer wall 94 of component 80 having a selected outer wall thickness 104. In particular, but not by way of limitation, in some such embodiments the use of jacketed core 980 including the at least one stand-off structure 720 enables repeatable and precise formation of outer wall 94 thinner than is achievable by other known methods.

Figure 13:
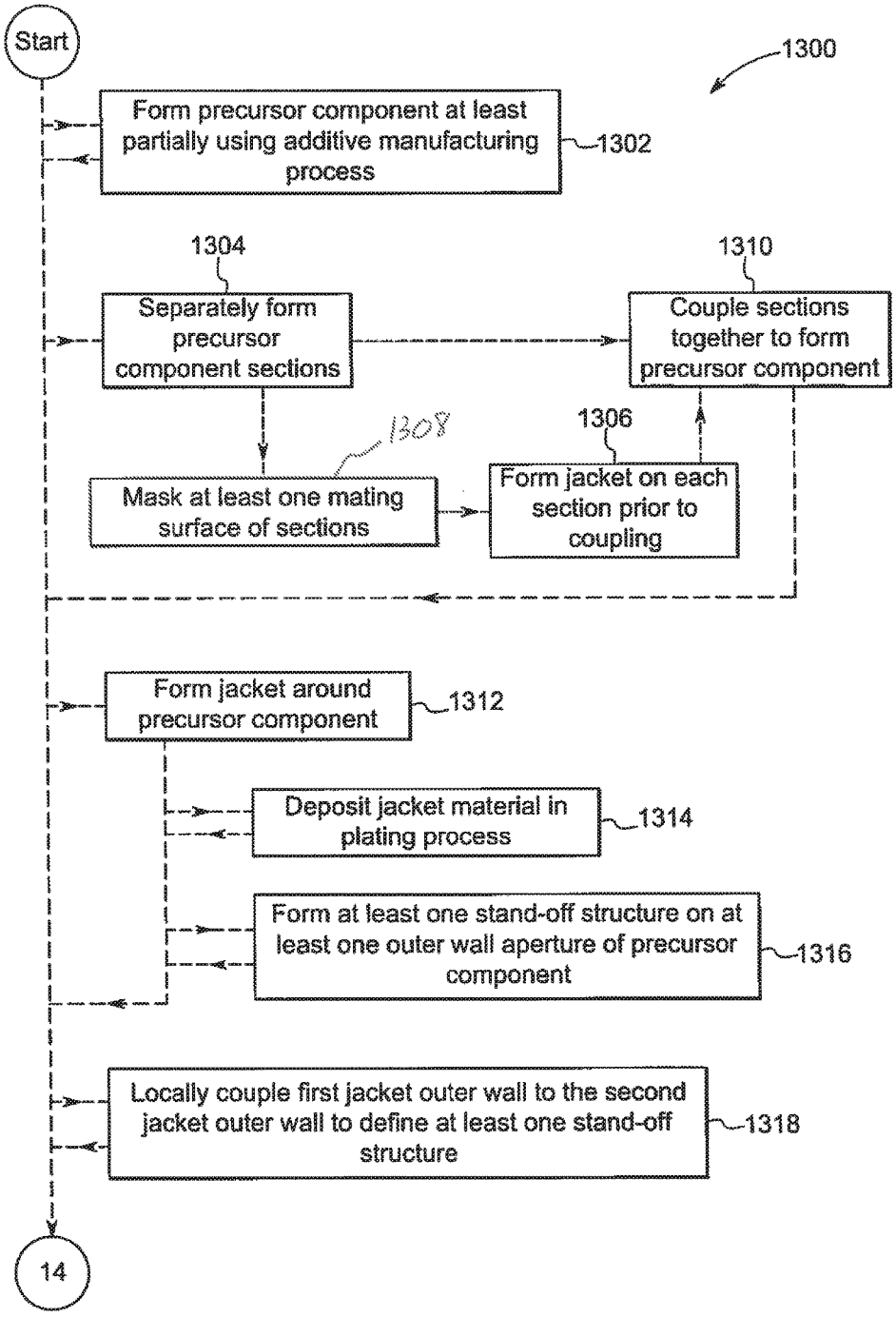
FIG. 13 is a flow diagram of an exemplary method of forming a component having an outer wall of a predetermined thickness, such as the exemplary component shown in FIG. 2.
Figure 14:
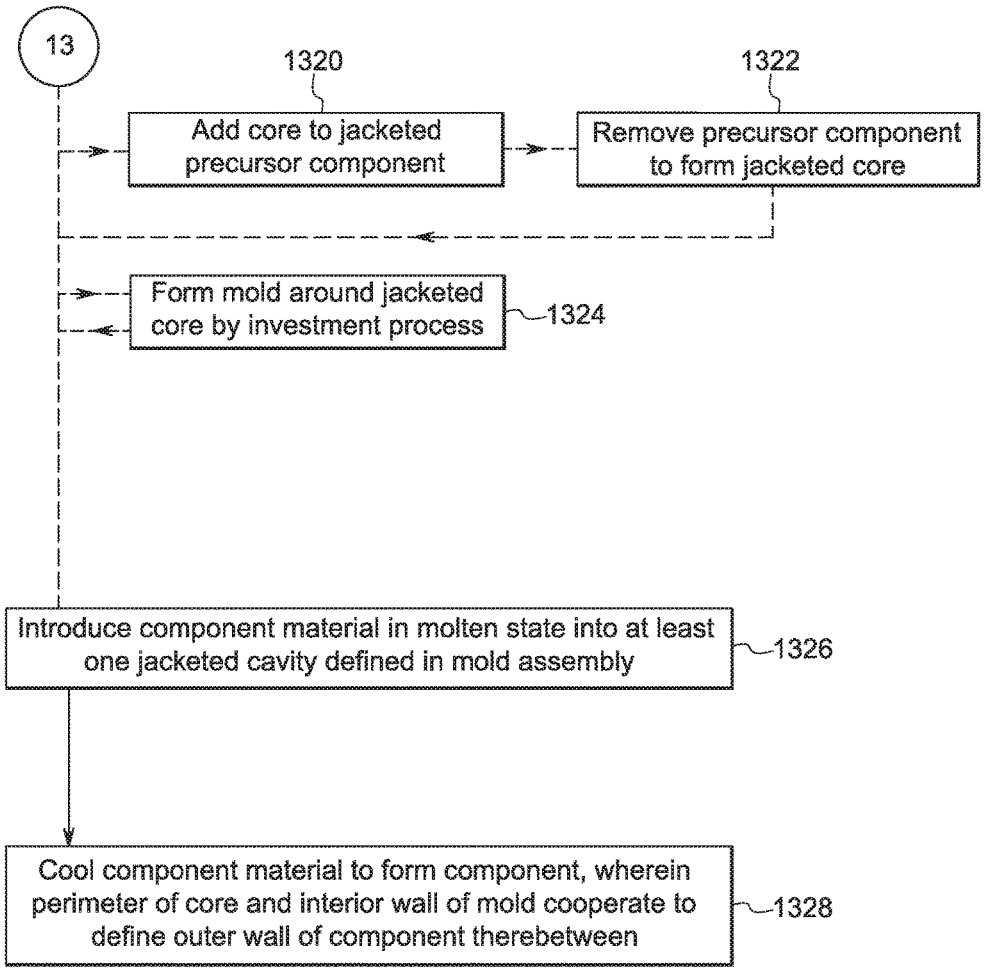
FIG. 14 is a continuation of the flow diagram of FIG. 13.

An exemplary method 1300 of forming a component, such as component 80, having an outer wall of a predetermined thickness, such as outer wall 94 having predetermined thickness 104, is illustrated in a flow diagram in FIGS. 13-14. With reference also to FIGS. 1-12, exemplary method 1300 includes introducing 1326 a component material, such as component material 78, in a molten state into at least one jacketed cavity, such as at least one jacketed cavity 900, defined in a mold assembly, such as mold assembly 1001. The mold assembly includes a jacketed core, such as jacketed core 980, positioned with respect to a mold, such as mold 1000. The mold includes an interior wall, such as interior wall 1002, that defines a mold cavity within the mold, such as mold cavity 1003. The jacketed core includes a jacket, such as jacket 700, that includes a first jacket outer wall, such as first jacket outer wall 792, coupled against the interior wall, a second jacket outer wall, such as second jacket outer wall 793, positioned interiorly from the first jacket outer wall, and the at least one jacketed cavity defined therebetween. The jacketed core also includes a core, such as core 800, positioned interiorly from the second jacket outer wall. The core includes a perimeter, such as perimeter 806, coupled against the second jacket outer wall. The jacket separates the perimeter from the interior wall by the predetermined thickness.

Method 1300 also includes cooling 1328 the component material to form the component. The perimeter and the interior wall cooperate to define the outer wall of the component therebetween.

In certain embodiments, method 1300 also includes locally coupling 1318 the first jacket outer wall to the second jacket outer wall to define at least one stand-off structure, such as stand-off structure 720, that separates the perimeter from the interior wall by the predetermined thickness.

In certain embodiments, method 1300 also includes forming 1312 the jacket around a precursor component, such as precursor component 580, shaped to correspond to a shape of at least portions of the component. In some such embodiments, an outer wall of the precursor component, such as outer wall 594, includes at least one outer wall aperture, such as outer wall aperture 520, defined therein and extending therethrough, and the step of forming 1312 the jacket further includes forming 1316 at least one stand-off structure, such as stand-off structure 720, on the at least one outer wall aperture. The at least one stand-off structure separates the perimeter from the interior wall by the predetermined thickness. Additionally or alternatively, in some such embodiments, method 1300 further includes forming 1302 the precursor component at least partially using an additive manufacturing process. Additionally or alternatively, the step of forming 1312 the jacket further includes depositing 1314 the jacket material on the precursor component in a plating process, as described above.

Additionally or alternatively, method 1300 further includes separately forming 1304 a plurality of precursor component sections, such as precursor component sections 1280, and coupling 1310 the plurality of sections together to form the precursor component. In some such embodiments, the step of forming 1312 the jacket includes forming 1306 the jacket on each of the sections prior to the step of coupling 1310 the sections together, and method 1300 also includes masking 1308 at least one mating surface, such as mating surface 1202, of the plurality of sections prior to the step of forming 1306 the jacket, such that deposition of the jacket material on the at least one mating surface is inhibited.

In certain embodiments, method 1300 further includes adding 1320 the core to the jacketed precursor component to form a jacketed cored precursor component, such as jacketed cored precursor component 880, and removing 1322 the precursor component from the jacketed cored precursor component to form the jacketed core.

In some embodiments, method 1300 also includes forming 1324 the mold around the jacketed core by an investment process, as described above.

The above-described embodiments of mold assemblies and methods enable making of components having an outer wall of a predetermined thickness with improved precision and repeatability as compared to at least some known mold assemblies and methods. Specifically, the mold assembly includes a jacketed core that includes at least one jacketed cavity defined between jacket outer walls, such that the jacket separates a perimeter of the core from an interior wall of the mold by the predetermined thickness. The core perimeter and mold interior wall cooperate to define the outer wall of the component therebetween. Also specifically, the jacket protects the core from damage and facilitates preserving the selected cavity space dimensions between the core perimeter and the mold interior wall, for example by inhibiting the core and mold from shifting, shrinking, and/or twisting with respect to each other during firing of the mold. Also specifically, the jacketed core automatically provides the preselected outer wall thickness without use of locating pins, thus reducing a time and cost of preparing the mold assembly for prototyping or production operations. In some cases, the above-described embodiments enable formation of components having relatively thin outer walls that cannot be precisely and/or repeatably formed using other known mold assemblies and methods.

An exemplary technical effect of the methods, systems, and apparatus described herein includes at least one of: (a) reducing or eliminating fragility problems associated with forming, handling, transport, and/or storage of a core used in forming a component having a preselected outer wall thickness; (b) improving precision and repeatability of formation of components having an outer wall of a predetermined thickness, particularly, but not limited to, components having relatively thin outer walls; and (c) enabling casting of components having an outer wall of a predetermined thickness without use of locating pins.

Exemplary embodiments of mold assemblies and methods including jacketed cores are described above in detail. The jacketed cores, and methods and systems using such jacketed cores, are not limited to the specific embodiments described herein, but rather, components of systems and/or steps of the methods may be utilized independently and separately from other components and/or steps described herein. For example, the exemplary embodiments can be implemented and utilized in connection with many other applications that are currently configured to use cores within mold assemblies.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of forming a component having an outer wall of a predetermined thickness, said method comprising:

introducing a component material in a molten state into at least one jacketed cavity defined in a mold assembly, the mold assembly including a jacketed core positioned with respect to a mold, wherein the mold includes an interior wall that defines a mold cavity within the mold, and the jacketed core includes:

a jacket that includes a first jacket outer wall coupled against the interior wall, a second jacket outer wall positioned interiorly from the first jacket outer wall, and the at least one jacketed cavity defined therebetween; and a core positioned interiorly from the second jacket outer wall, the core including a perimeter coupled against the second jacket outer wall, wherein the jacket separates the perimeter from the interior wall by the predetermined thickness;

cooling the component material to form the component, wherein the perimeter and the interior wall cooperate to define the outer wall of the component therebetween; and forming the jacket around a precursor component, wherein the precursor component is shaped to correspond to a shape of at least portions of the component and an outer wall of the precursor component includes at least one outer wall aperture defined therein and extending therethrough, and forming the jacket further comprises forming at least one stand-off structure on the at least one outer wall aperture, the at least one stand-off structure separates the perimeter from the interior wall by the predetermined thickness.

2. The method of claim 1, further comprising locally coupling the first jacket outer wall to the second jacket outer wall to define at least one stand-off structure that separates the perimeter from the interior wall by the predetermined thickness.

3. The method of claim 2, wherein said jacket further comprises a filler material inserted into each said at least one stand-off structure, such that a shape of said first jacket outer wall corresponds to an exterior shape of the component proximate said at least one stand-off structure.

4. The method of claim 1, wherein forming the jacket comprises depositing a jacket material on the precursor component in a plating process.

5. The method of claim 1, further comprising forming the precursor component at least partially using an additive manufacturing process.

6. The method of claim 1, further comprising:

separately forming a plurality of precursor component sections; and coupling the plurality of sections together to form the precursor component.

7. The method of claim 6, wherein forming the jacket comprises forming the jacket on each of the sections prior to coupling the sections together, said method further comprising masking at least one mating surface of the plurality of sections prior to forming the jacket, such that formation of the jacket on the at least one mating surface is inhibited.

8. The method of claim 1, further comprising:

adding the core to the jacketed precursor component to form a jacketed cored precursor component; and removing the precursor component from the jacketed cored precursor component to form the jacketed core.

9. The method of claim 1, further comprising forming the mold around the jacketed core by an investment process.

10. The method of claim 1, wherein a combined thickness of said first jacket outer wall, said second jacket outer wall, and said at least one jacketed cavity corresponds to the predetermined thickness.

11. The method of claim 1, wherein said jacket further comprises opposing jacket inner walls positioned interiorly from said second jacket outer wall, said opposing jacket inner walls define at least one inner wall jacketed cavity therebetween, said at least one inner wall jacketed cavity configured to receive the component material in the molten state and form an inner wall of the component therein.

12. The method of claim 11, wherein said core comprises at least one chamber core portion positioned between a first of said jacket inner walls and said second jacket outer wall.

13. The method of claim 12, wherein said core comprises at least one plenum core portion positioned interiorly from a second of said jacket inner walls.

14. The method of claim 12, wherein said core comprises at least one return channel core portion configured to define at least one fluid return channel within the component, the at least one fluid return channel in flow communication with a chamber of the component defined by said at least one chamber core portion.

15. The method of claim 12, wherein said core comprises a plurality of inner wall aperture core portions each extending through said at least one inner wall jacketed cavity.

16. The method of claim 1, wherein the component material is an alloy, and said jacket is formed from a jacket material that comprises at least one constituent material of the alloy.

* * * * *